US010738578B2

(12) United States Patent
Chuprakov et al.

(10) Patent No.: US 10,738,578 B2
(45) Date of Patent: Aug. 11, 2020

(54) METHOD FOR IMPROVED DESIGN OF HYDRAULIC FRACTURE HEIGHT IN A SUBTERRANEAN LAMINATED ROCK FORMATION

(71) Applicant: SCHLUMBERGER TECHNOLOGY CORPORATION, Sugar Land, TX (US)

(72) Inventors: Dimitry Chuprakov, Belmont, MA (US); Romain Charles Andre Prioul, Somerville, MA (US); Xiaowei Weng, Fulshear, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 260 days.

(21) Appl. No.: 15/315,943

(22) PCT Filed: Jun. 5, 2015

(86) PCT No.: PCT/US2015/034510
§ 371 (c)(1),
(2) Date: Dec. 2, 2016

(87) PCT Pub. No.: WO2015/188115
PCT Pub. Date: Dec. 10, 2015

(65) Prior Publication Data

US 2017/0096886 A1 Apr. 6, 2017

Related U.S. Application Data

(60) Provisional application No. 62/008,082, filed on Jun. 5, 2014.

(51) Int. Cl.

| | |
|---|---|
| ***E21B 43/26*** | (2006.01) |
| ***E21B 49/00*** | (2006.01) |
| *E21B 43/00* | (2006.01) |

(52) U.S. Cl.
CPC ..... *E21B 43/26* (2013.01); *E21B 49/00* (2013.01); *E21B 43/00* (2013.01)

(58) Field of Classification Search
CPC ..... E21B 43/00; E21B 43/26; E21B 43/267; E21B 49/00
See application file for complete search history.

(56) References Cited

U.S. PATENT DOCUMENTS 5,413,179 A 5/1995 Scott, III
5,441,110 A * 8/1995 Scott, III ..... E21B 43/267 166/308.1

(Continued)

FOREIGN PATENT DOCUMENTS

CN 103670358 A 3/2014
EP 2497900 A2 9/2012

(Continued)

OTHER PUBLICATIONS

Decision to Grant issued in Russian Patent Application No. 2016147515 dated Feb. 13, 2018; 19 pages (with Englis translation).

(Continued)

*Primary Examiner* — Robert E Fuller
*Assistant Examiner* — Christopher J Sebesta
(74) *Attorney, Agent, or Firm* — Cathy Hewitt

(57) ABSTRACT

Embodiments herein relate to a method for hydraulic fracturing a subterranean formation traversed by a wellbore including characterizing the formation using measured properties of the formation, including mechanical properties of geological interfaces, identifying a formation fracture height wherein the identifying comprises calculating a contact of a hydraulic fracture surface with geological interfaces, and fracturing the formation wherein a fluid viscosity or a fluid flow rate or both are selected using the calculating. Embodiments herein also relate to a method for hydraulic fracturing (Continued)

a subterranean formation traversed by a wellbore including measuring the formation comprising mechanical properties of geological interfaces, characterizing the formation using the measurements, calculating a formation fracture height using the formation characterization, calculating an optimum fracture height using the measurements, and comparing the optimum fracture height to the formation fracture height.

19 Claims, 16 Drawing Sheets

(56) References Cited

U.S. PATENT DOCUMENTS

| | | | | |
|---|---|---|---|---|
| 5,900,544 | A | 5/1999 | Weng et al. | |
| 6,876,959 | B1 * | 4/2005 | Peirce | E21B 43/26 702/11 |
| 7,819,181 | B2 | 10/2010 | Entov et al. | |
| 8,061,424 | B2 | 11/2011 | Willberg et al. | |
| 2006/0224370 | A1 * | 10/2006 | Siebrits | E21B 43/26 703/10 |
| 2007/0294034 | A1 * | 12/2007 | Bratton | E21B 41/00 702/6 |
| 2010/0250216 | A1 * | 9/2010 | Narr | G06F 17/5018 703/10 |
| 2011/0247824 | A1 | 10/2011 | Gu | |
| 2012/0232872 | A1 * | 9/2012 | Nasreldin | G01V 99/005 703/10 |
| 2013/0319657 | A1 | 12/2013 | Siebrits et al. | |
| 2014/0076543 | A1 | 3/2014 | Ejofodomi et al. | |
| 2015/0066463 | A1 * | 3/2015 | Shetty | E21B 41/00 703/10 |

FOREIGN PATENT DOCUMENTS

| | | | |
|---|---|---|---|
| WO | 2013067363 | A1 | 5/2013 |
| WO | 2014032003 | A1 | 2/2014 |

OTHER PUBLICATIONS

Renshaw, C. E., and D. D. Pollard (1995) "An Experimentally Verified Criterion for Propagation across Unbounded Frictional Interfaces in Brittle, Linear Elastic-Materials", International Journal of Rock Mechanics and Mining Sciences & Geomechanics Abstracts, 32(3), pp. 237-249.

Savitski, A. A., and E. Detournay (2002) "Propagation of a penny-shaped fluid-driven fracture in an impermeable rock: asymptotic solutions", Int J Solids Struct, 39(26), pp. 6311-6337.

Settari, A., and M. P. Cleary (1986) "Development and Testing of a Pseudo-Three-Dimensional Model of Hydraulic Fracture Geometry", SPE Production EngineerinG, Nov. 1986, pp. 449-466.

Warpinski, N. R., P. T. Branagan, R. E. Peterson, and S. L. Wolhart (1998) "An Interpretation of M-Site Hydraulic Fracture Diagnostic Results", paper presented at SPE Rocky Mountain Regional/Low-Permeability Reservoirs Symposium, SPE 39950, Society of Petroleum, Engineers, Inc., Denver, Colorado, Apr. 5-8, 1998, 14 pages.

Zang, X., R. G. Jeffrey, and M. Thiercelin (2008) "Escape of fluid-driven fractures from frictional bedding interfaces: A numerical study", J Struct Geol, 30(4), pp. 478-490.

Kresse et al., "Effect of Flow Rate and Viscosity on Complex Fracture Development in UFM Model", Chapter 9, In: Effective and Sustainable Hydraulic Fracturing, InTech, May 17 2013, pp. 183-210.

Abbas et al., "Limited Height Growth and Reduced Opening of Hydraulic Fractures due to Fracture Offsets: An XFEM Application", SPE 168622, SPE Hydraulic Fracturing Technology Conference, Feb. 4, 2014, 13 pages.

Kresse et al., "Hydraulic Fracturing in Formation with Permeable Natural Fractures", Chapter 14, In: Effective and Sustainable Hydraulic Fracturing, InTech, May 17, 2013, pp. 287-310.

Chuprakov et al., "Injection-Sensitive Mechanics of Hydraulic Fracture Interaction with discontinuities", Rock Mechanics and Rock Engineering, Springer Vienna, vol. 47, No. 5, May 24, 2014, pp. 1625-1640.

Extended European Search Report issued in European Patent Appl. No. 15803804.2 dated Apr. 5, 2018; 12 pages.

Nuller, B., E. Karapetian, and M. Kachanov (1998) "On the Stress Intensity Factor for the Elliptical Crack", Int J Fracture, 92(2), pp. 15-20.

Keer, L. M., and S. H. Chen (1981) "Intersection of a pressurized crack with a joint", Journal of Geophysical Research, 86(B2), pp. 1032-1038.

Leguillon, D. (2002) "Strength or toughness? A criterion for crack onset at a notch", Eur J Mech a-Solid, 21(1), pp. 61-72.

Leguillon, D., and Z. Yosibash (2003) "Crack onset at a v-notch. Influence of the notch tip radius", Int J Fracture, 122 (1-2), pp. 1-21.

Written Opinion issued in International Patent Application No. PCT/US2015/034510 dated Aug. 31, 2015; 9 pages.

International Search Report issued in International Patent Application No. PCT/US2015/034510 dated Aug. 31, 2015; 3 pages.

Chuprakov et al., "Hydraulic Fracture Height Containment by Weak Horizontal Interfaces", SPE-173337-MS, SPE Hydraulic Fracturing Technology Conference, Feb. 3-5, 2015, 17 pages.

Adachi et al., "Analysis of the classical pseudo-3D model for hydraulic fracture with equilibrium height growth across stress barriers", International Journal of Rock Mechanics and Mining Sciences, vol. 47, No. 4, pp. 625-639, 2010.

Athavale et al., "Laboratory Hydraulic Fracturing Tests on Small Homogeneous and Laminated Blocks", ARMA 08-067, Paper presented at the The 42nd U.S. Rock Mechanics Symposium (USRMS), San Francisco, CA, Jun. 29-Jul. 2, 2008, 9 pages.

Barree et al., "Effects of Shear Planes and Interfacial Slippage on Fracture Growth and Treating Pressures", SPE 48926, Paper presented at the SPE Annual Technical Conference and Exhibition, New Orleans, Louisiana, Sep. 27-30, 1998, pp. 11-16.

Boyer, II et al., "Measurement of Coalbed Properties for Hydraulic Fracture Design and Methane Production", SPE 15258, Paper presented at the SPE Unconventional Gas Technology Symposium, Louisville, Kentucky, May 18-21, 1986, 8 pages.

Chuprakov et al., "A variational approach to analyze a natural fault with hydraulic fracture based on the strain energy density criterion", Theoretical and Applied Fracture Mechanics, vol. 53, No. 3, 2010, pp. 221-232.

Chuprakov et al., "Hydraulic-Fracture Propagation in a Naturally Fractured Reservoir", SPE 128715, SPE Production & Operations, Feb. 2011, pp. 88-97.

Cooke et al., "Fracture termination and step-over at bedding interfaces due to frictional slip and interface opening", Journal of Structural Geology, vol. 23, 2001, pp. 223-238.

Daneshy, "Factors Controlling the Vertical Growth of Hydraulic Fractures", SPE 118789, Paper presented at the SPE Hydraulic Fracturing Technology Conference, The Woodlands, Texas, Jan. 19-21, 2009, 11 pages.

Fisher et al., "Hydraulic Fracture-Height Growth: Real Data", SPE 145949, Paper presented at the SPE Annual Technical Conference and Exhibition, Denver, Colorado, USA, Oct. 30-Nov. 2, 2011, 18 pages.

Gu et al., "Effect of Formation Modulus Contrast on Hydraulic Fracture Height Containment", SPE Production & Operations, May 2008, pp. 170-176.

Jeffrey et al., "A Detailed Comparison of Experimental and Numerical Data on Hydraulic Fracture Height Growth Through Stress Contrasts", SPE Journal, Sep. 2009, pp. 413-422.

Miskimins et al., "Modeling of Hydraulic Fracture Height Containment in Laminated Sand and Shale Sequences", SPE 80935, Paper presented at the SPE Production and Operations Symposium, Oklahoma City, Oklahoma, Mar. 22-25, 2003, 11 pages.

Palmer et al., "Three-Dimensional Hydraulic Fracture Propagation in the Presence of Stress Variations", Society of Petroleum Engineers Journal, 1983, pp. 870-878.

(56) References Cited

OTHER PUBLICATIONS

Teufel et al., "Hydraulic Fracture Propagation in Layered Rock: Experimental Studies of Fracture Containment", Society of Petroleum Engineers Journal, Feb. 1984, pp. 19-32.
Thiercelin et al., "Core-Based Prediction of Lithologic Stress Contrasts in East Texas Formations", SPE Formation Evaluation, Dec. 1994, pp. 251-258.
Thiercelin et al., "Stress field in the vicinity of a natural fault activated by the propagation of an induced hydraulic racture", ARMA-07-201, 1st Canada—U.S. Rock Mechanics Symposium, May 27-31, 2007, Vancouver, Canada, 9 pages.
Van Eekelen, "Hydraulic Fracture Geometry: Fracture Containment in Layered Formations", Society of Petroleum Engineers Journal, Jun. 1982, pp. 341-349.
Warpinski et al., "Influence of Geologic Discontinuities on Hydraulic Fracture Propagation", SPE Journal of Petroleum Technology, Feb. 1987, pp. 209-220, 998, and 999.
Zhang et al., "Effects of Frictional Geological Discontinuities on Hydraulic Fracture Propagation", SPE 106111, Paper presented at the SPE Hydraulic Fracturing Technology Conference, College Station, Texas USA, Jan. 29-31, 2007, 11 pages.
Office Action issued in Chinese Patent Appl. No. 201580029812.1 dated Jun. 11, 2018; 16 pages.
Examination Report issued in European Patent Appl. No. 15803804.2 dated Nov. 29, 2018; 4 pages.
Examination Report issued dated Dec. 18, 2018 in corresponding AU Application No. 2015269193; 3 pages.

* cited by examiner

METHOD FOR IMPROVED DESIGN OF HYDRAULIC FRACTURE HEIGHT IN A SUBTERRANEAN LAMINATED ROCK FORMATION

RELATED APPLICATION INFORMATION

This application is a 371 National Phase of PCT/US2015/034510 filed Jun. 5, 2015, which claims the benefit of U.S. Provisional Application No. 62/008,082 filed Jun. 5, 2014, both of which are incorporated herein in their entirety.

FIELD

This relates to the field of geomechanics and hydraulic fracture mechanics. This relates to oil-and-gas reservoir stimulation, performed by hydraulic fracturing of rock from the wellbore, including providing a technique to predict hydraulic fracture height growth in the rock affected by pre-existing weak mechanical horizontal interfaces such as bedding planes, lamination interfaces, slickensides, and others.

BACKGROUND

For context, we demonstrate the results of two fracture propagation modeling cases with different structure of rock interfaces with respect to the horizontal wellbore. In both examples, one hydraulic fracture is initiated at the horizontal wellbore and propagates in vertical and horizontal directions. The rock properties and in-situ stresses are the same in different layers dividing by the prescribed interfaces for both presented examples. The interfaces are cohesionless but frictional planes of weakness.

Case of Symmetrical Interfaces with Respect to Wellbore

In the first example, horizontal interfaces are located symmetrically with respect to the horizontal wellbore. Hydraulic fracture initiated and propagates across these interfaces as well as along them in the horizontal direction, as shown in the FIG. 1. FIG. 1 shows a hydraulic fracture propagating from the horizontal wellbore in the case of symmetrical placement of horizontal interfaces with respect to wellbore.

Propagating of both vertical tips of hydraulic fracture across the interfaces is relatively slow because of continuous stops at each if these interfaces. At the same time, lateral tips of the hydraulic fracture propagate without interaction with interfaces (parallel to them). As a result, the length of hydraulic fracture appears to be much longer than its height (FIG. 2).

FIG. 2 shows an upper, lower, and lateral fracture tip propagation with time of fluid injection (upper graph), and corresponding pressure response at the fracture inlet (lower graph) for symmetrical placement of the interfaces.

Case of Asymmetrical Interfaces with Respect to Wellbore

In the second modeling case, cohesionless horizontal interfaces are positioned asymmetrically with respect to the wellbore. Number of interfaces below the wellbore is less than that above the wellbore (see FIG. 3). The pumping schedule, the spacing between the interfaces, and all other parameters of the rock and fracture remain the same, as in the first example. FIG. 3 shows hydraulic fracture propagating from the horizontal wellbore in the case of asymmetrical placement of horizontal interfaces with respect to wellbore.

Modeling shows that in this case after crossing two interfaces below the wellbore, the hydraulic fracture will be completely stopped at one of the upper interfaces while freely propagates downward (FIG. 4). FIG. 4 illustrates an upper, lower, and lateral fracture tip propagation with time of fluid injection (upper graph), and corresponding pressure response at the fracture inlet (lower graph) for asymmetrical placement of the interfaces.

These two examples indicate that the preliminary measurement of the weakness planes in rock and adequate modeling of fracture propagation in a layered formation are needed to identify fracture height containment in a layered rock adequately. And oppositely, missing the information about the heterogeneous profile of the rock strength in the vertical direction and prominent interfaces can result in wrong results in prediction of the fracture height containment conditioned by interaction of the hydraulic fracture with weakness planes.

Hydraulic fracturing used for the purpose of reservoir stimulation typically aims at propagating sufficiently long fractures in a reservoir. The fracture length can be as large as several hundred meters in horizontal direction. With such fracture extent the layered rock structure reveals severe heterogeneity vertically. Depending of the rock type, sedimentary laminations or beddings can have thickness in the range of millimeters to meters. Unequal variation of rock properties in vertical and horizontal directions results in noticeable restriction of the fracture height growth with respect to lateral fracture propagation. Since the beginning of fracturing era attention to the hydraulic fracture height containment was always recognized.

Subsurface three-dimensional propagation of hydraulic fractures (hereafter HF) typically implies simultaneous fracture growth in horizontal and vertical directions. Typical horizontal HF extent during field treatments varies from tens to hundreds meters along the intended formation layer. As opposed to that, vertical fracture extent appears much shorter in size because of large contrast of rock properties and tectonic stresses, as well as pre-existing horizontal bedding and lamination interfaces. There are several recognized mechanisms controlling the vertical HF growth (upward or downward) in geologic formations: (1) minimum horizontal stress variation as a function of depth (hereafter called "stress contrast" or "mechanism 1"), (2) elastic moduli contrast between adjacent and different lithological layers (hereafter called "elasticity contrast" or "mechanism 2"), and (3) weak mechanical interface between similar or different lithological layers (hereafter called "weak interface" or "mechanism 3"). A "weak mechanical interface" or "weak interface" or "plane of weakness" refers to any mechanical discontinuity that has low bonding strength (shear, tensile, stress intensity, friction) with respect to the strength of the rock matrix. A weak interface represents a potential barrier for fracture propagation as follows: when the HF reaches the weak interface, it creates a slip zone near the contact as shown by both analytical and numerical studies. Slip near the contact zone can arrest fracture propagation and lead to extensive fluid infiltration or even hydraulic opening of the interface by forming so called T-shape fractures. Such T-shape fractures have been repeatedly observed in various mineback observations in coal bed formations.

Nowadays, the "stress contrast" mechanism is the main used in most HF modeling codes to control vertical height growth, both for pseudo3D and planar3D models. The "elastic contrast" mechanism is usually not explicitly modeled in most HF modeling codes, but is in some way addressed by the "stress contrast" mechanism as vertical stress profile of minimum horizontal stress are often derived from a calibrated poroelastic model and overburden stress profile (isotropic and transverse isotropy can be treated) that depends on the elasticity of the formation. The "weak interface" mechanism has drawn less attention in the hydraulic fracturing community up to date, though it has been well recognized from field fracturing jobs and discussed in literature as far back as the 1980s. This lack of interest may have been caused by the lack of characterization of the location of the weak interfaces in deep formations and/or the lack of measurements of their mechanical properties (shear and tensile strength, fracture toughness, friction coefficient and permeability). At the same time the "weak interface" mechanism is one of the only of the above mechanisms that can completely stop the HF from further propagating upward or downward in formations. The main reasons for fracture tip termination at weak interfaces are the interface slippage, pressurization by penetrated fracturing fluid, or even mechanical opening of the interface. In contrast, the first two mechanisms may only temporarily stop the HF until the net pressure is increased in the HF up to a threshold level that will allow the HF to further propagate. The "weak interface" containment mechanism may be more important than "stress" or "elastic contrast" mechanisms and may be the reason why HF are often well contained in vertical extent despite apparent absence of any observed "stress" or "elastic contrast." In any event, more effective methods for formation characterization, existing fracture influence on fracture development, and characterization of fracture generation are needed.

FIGURES

FIG. 1 shows a hydraulic fracture propagating from the horizontal wellbore in the case of symmetrical placement of horizontal interfaces with respect to wellbore.

FIG. 2. Upper, lower and lateral fracture tip propagation with time of fluid injection (upper graph), and corresponding pressure response at the fracture inlet (lower graph) for symmetrical placement of the interfaces.

FIG. 3. Hydraulic fracture propagating from the horizontal wellbore in the case of asymmetrical placement of horizontal interfaces with respect to wellbore.

FIG. 4 includes upper, lower and lateral fracture tip propagation with time of fluid injection (upper graph), and corresponding pressure response at the fracture inlet (lower graph) for asymmetrical placement of the interfaces.

Figure 7:
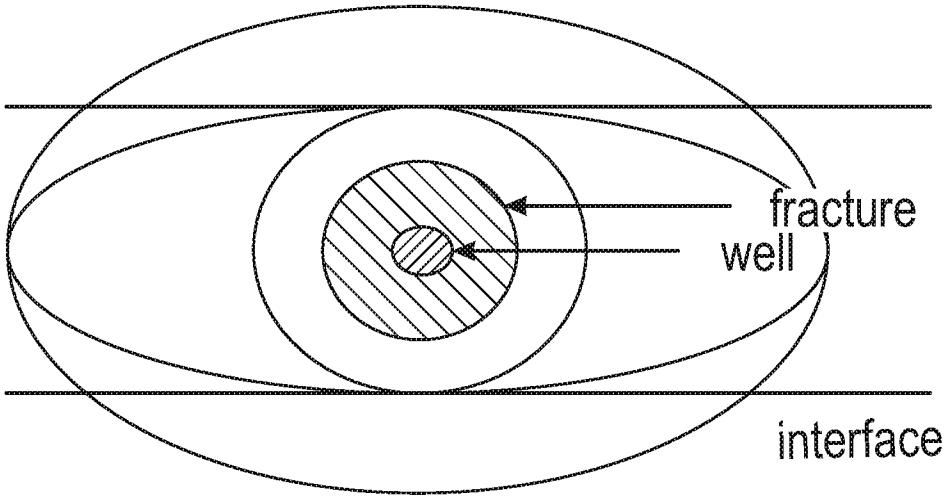

FIG. 7 provides examples of stages for 3D frac propagation across weak planes.

Figure 8:
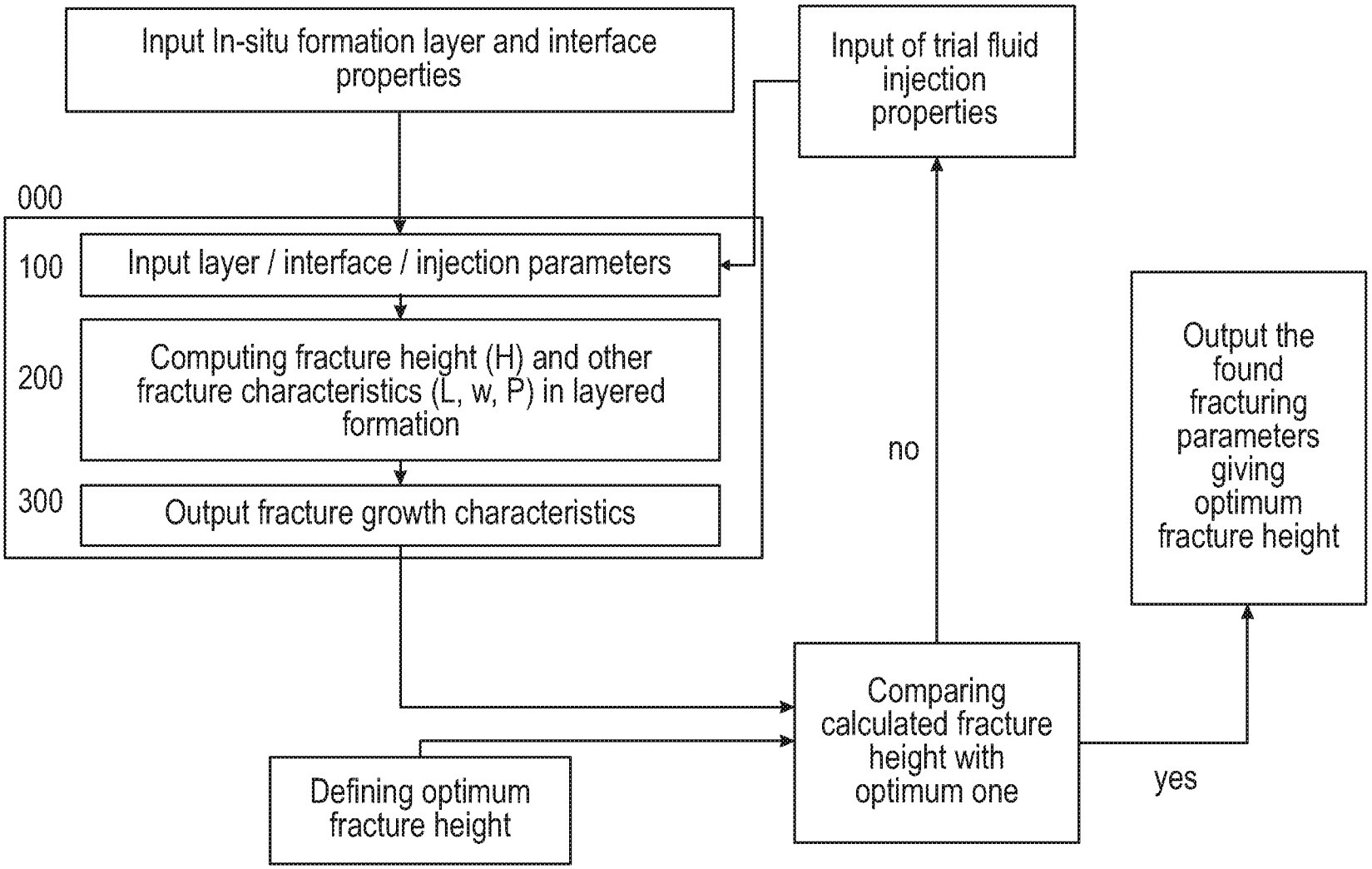

FIG. 8 is a flow chart of methods for an embodiment.

Figure 9:
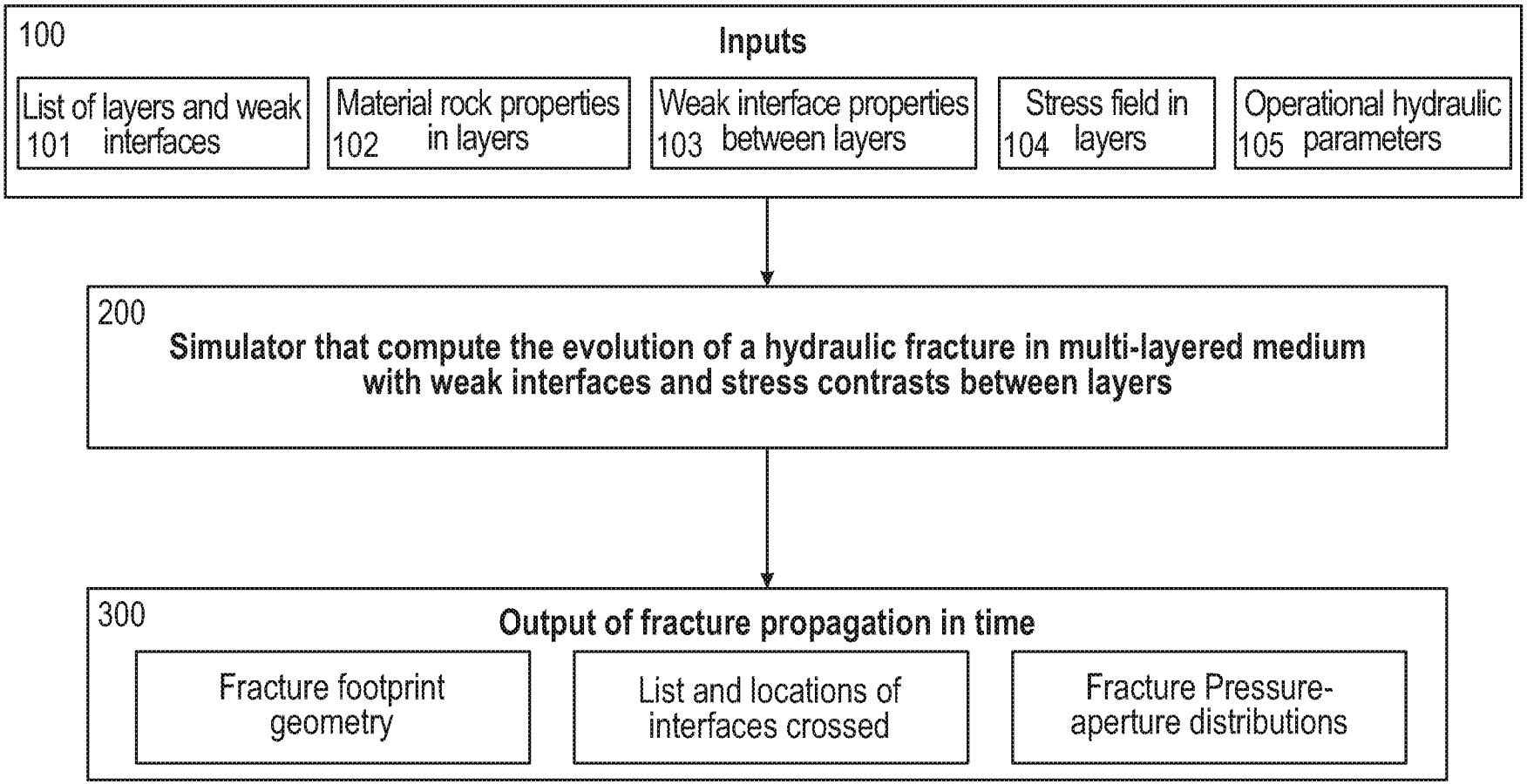

FIG. 9 is a flow chart of a component of a method for an embodiment.

Figure 10:
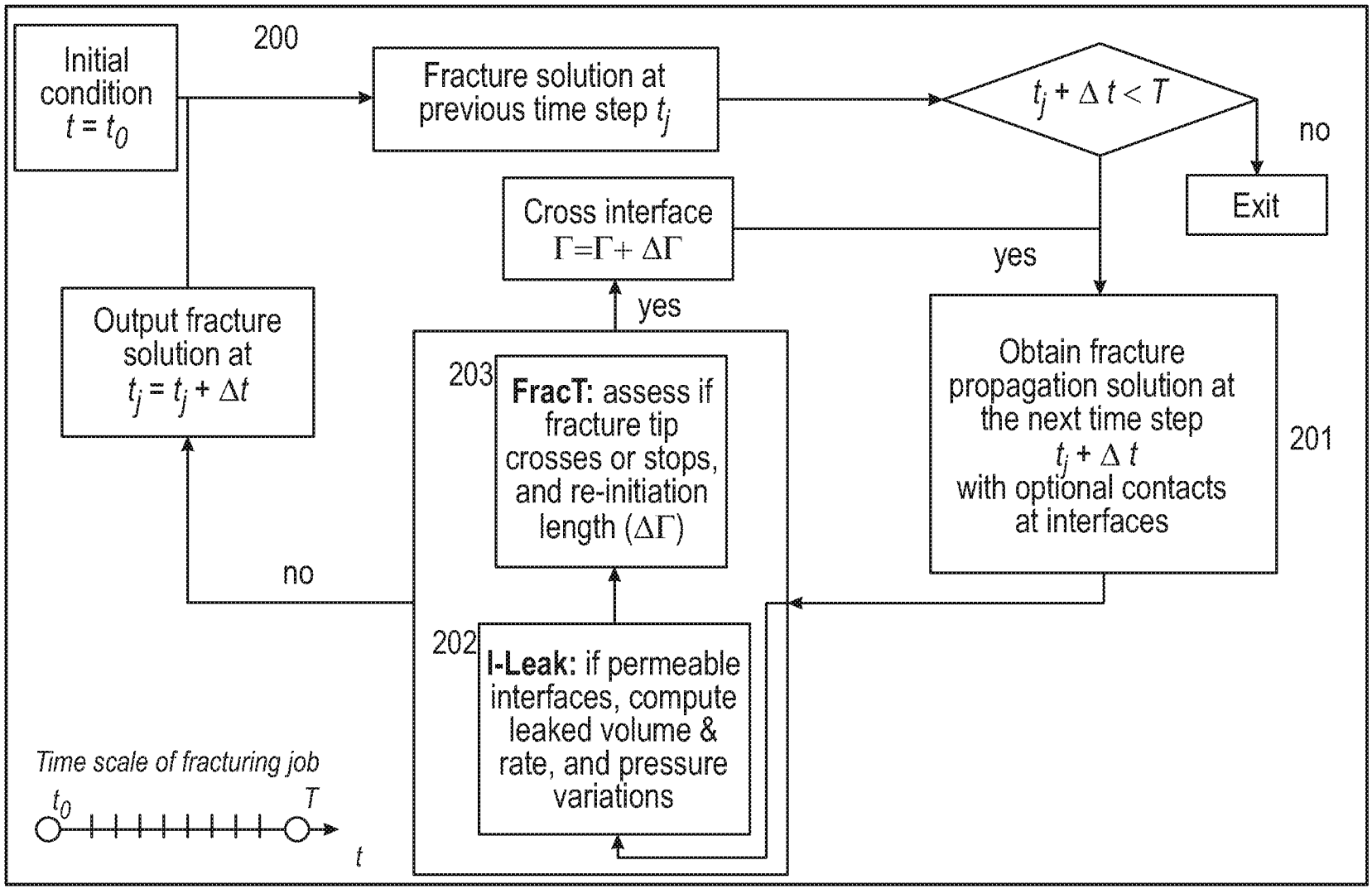

FIG. 10 depicts an embodiment of an algorithm of the HF simulator (200) workflow from the beginning of the fracturing job t0 up to the end T.

Figure 11:
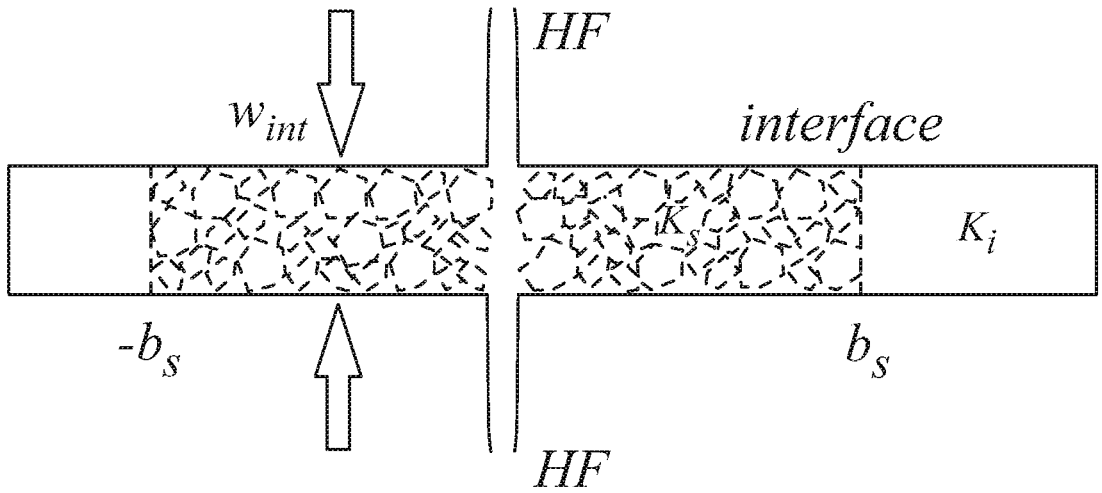
Figure 11:
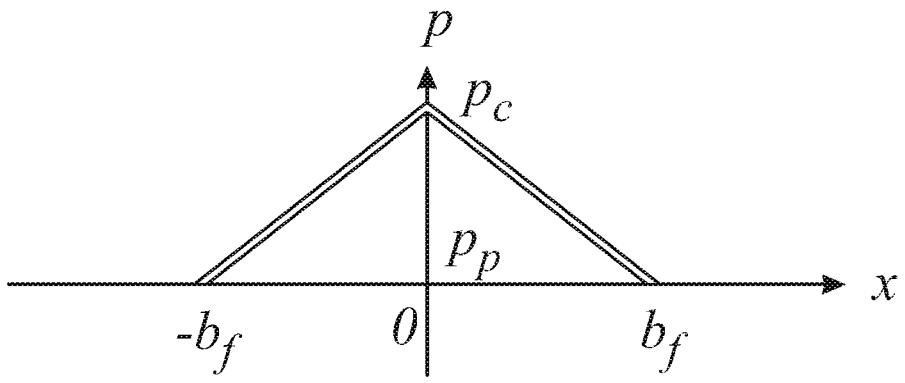

FIG. 11 illustrates a horizontal interface crossed by the vertical hydraulic fracture (top), and schematic distribution of the percolated fluid pressure along the interface (bottom).

Figure 12:
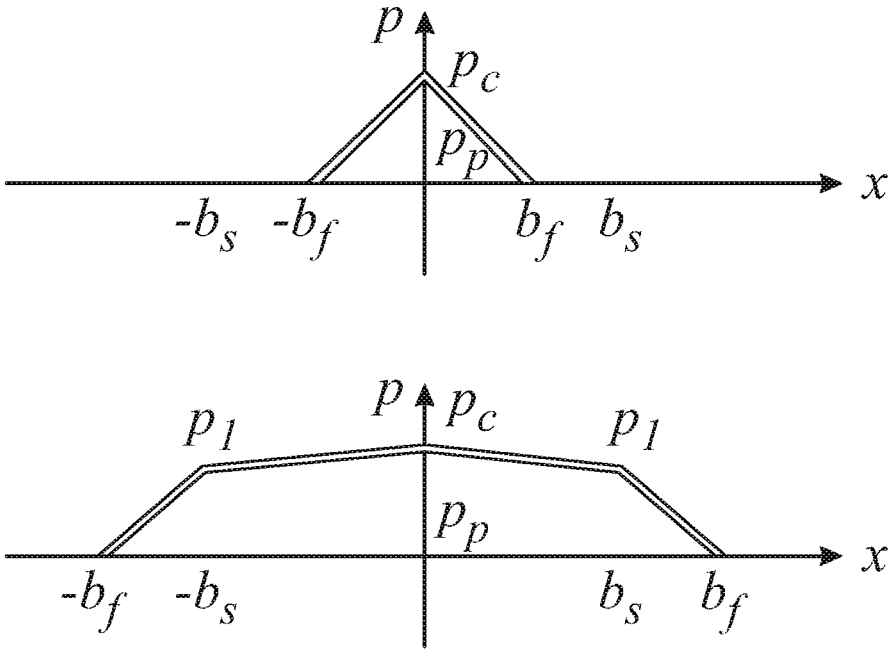

FIG. 12 provides a profile of fluid pressure along the interface for the "in-slip" (top) and "out-of-slip" (bottom) regimes of percolation.

Figure 13:
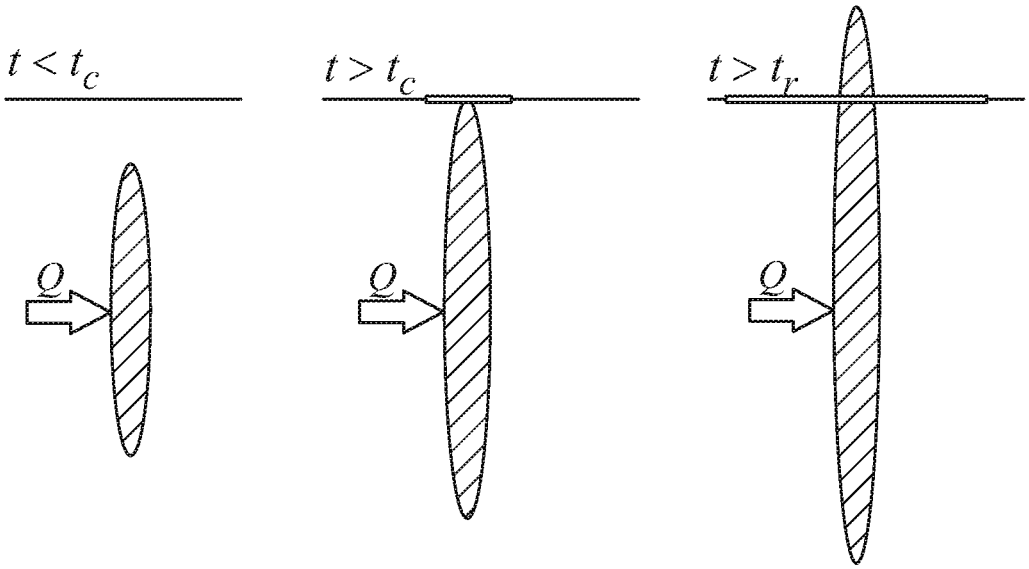

FIG. 13 is a series of schematic diagrams to show a hydraulic fracture propagating upward and downward in plane-strain geometry (vertical cross-section).

Figure 14:
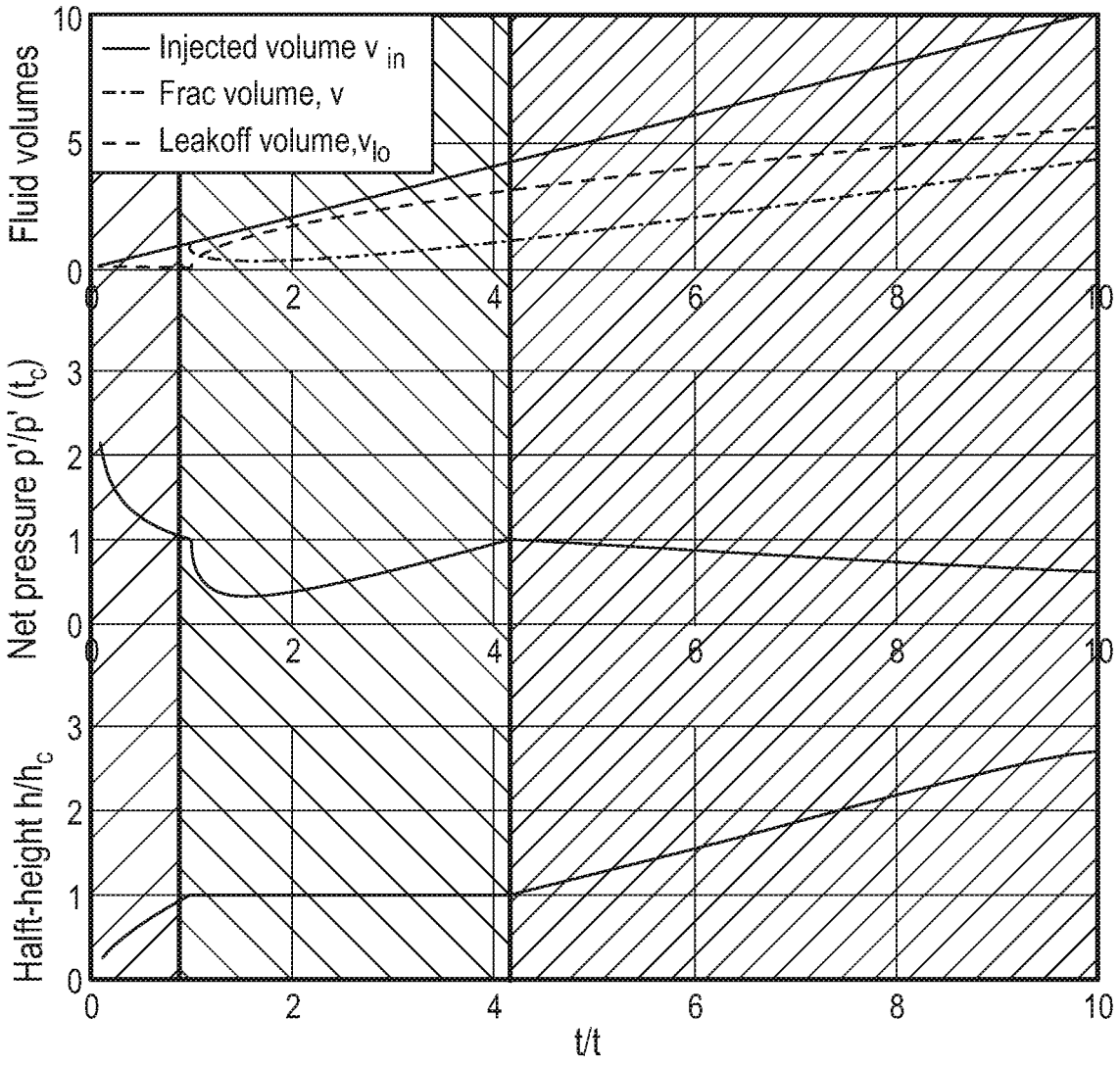

FIG. 14 is a plot that shows the injected, fracture and leaked-off fluid volumes (top), net pressure (middle), and hydraulic fracture halfheight (bottom) during the whole cycle of fluid injection into the fracture.

Figure 15:
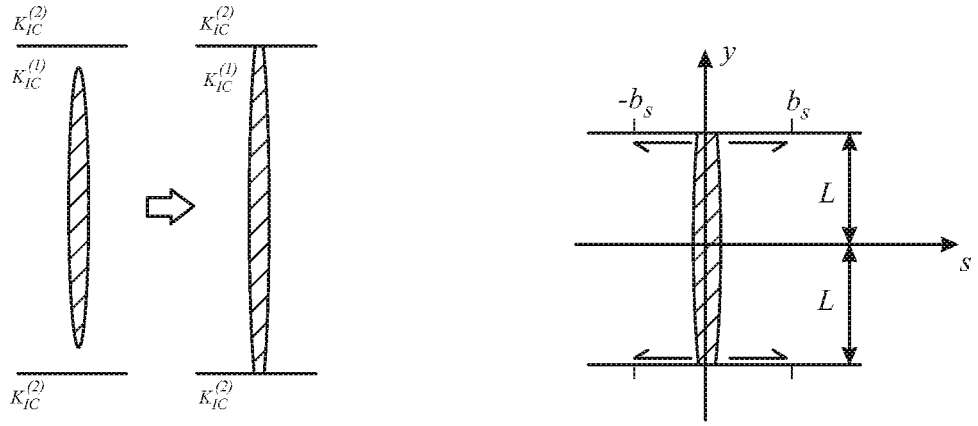

FIG. 15 is a two-sided contact of a vertically growing fracture and weak horizontal interfaces (left), interface activation, and fracture tip blunting as a result of the contact with the interfaces (right)

Figure 16:
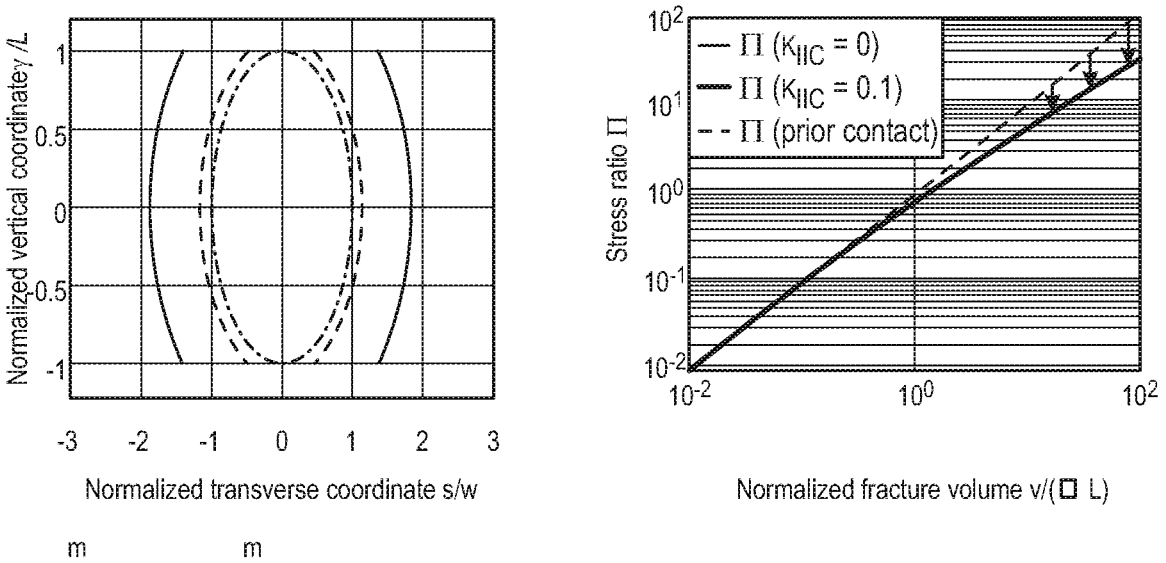

FIG. 16 provides profiles of the vertical fracture opening (left) at the contact with two cohesionless interfaces and normalized fracture volume versus stress ratio (right).

Figure 17:
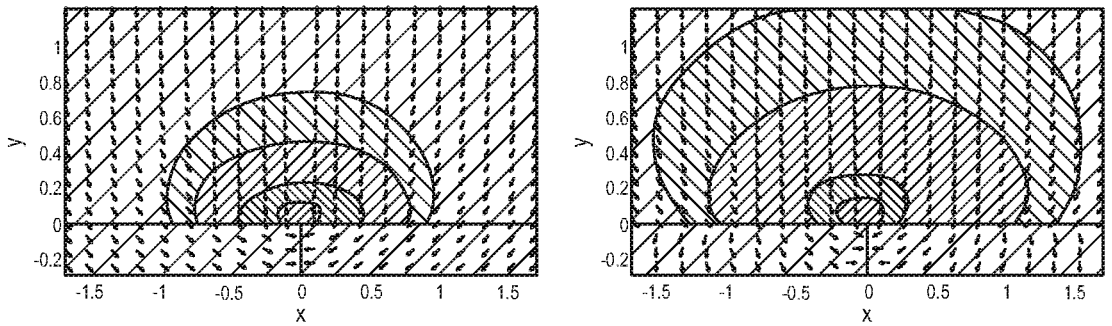

FIG. 17 includes the maximum tensile stress component generated on the opposite side of the cohesionless (left) and cohesional interface with $\kappa_{IIC}=1$ (right).

Figure 18:
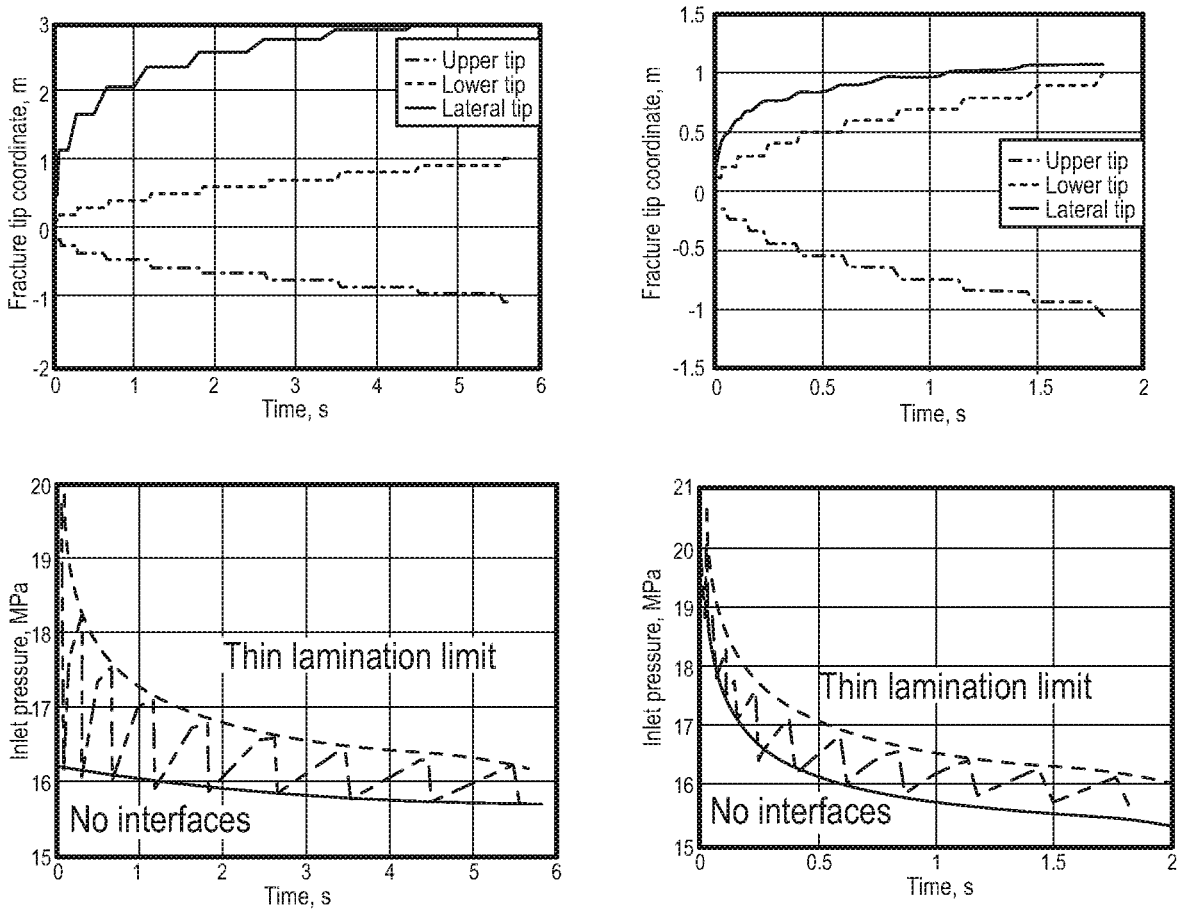
Figure 19:
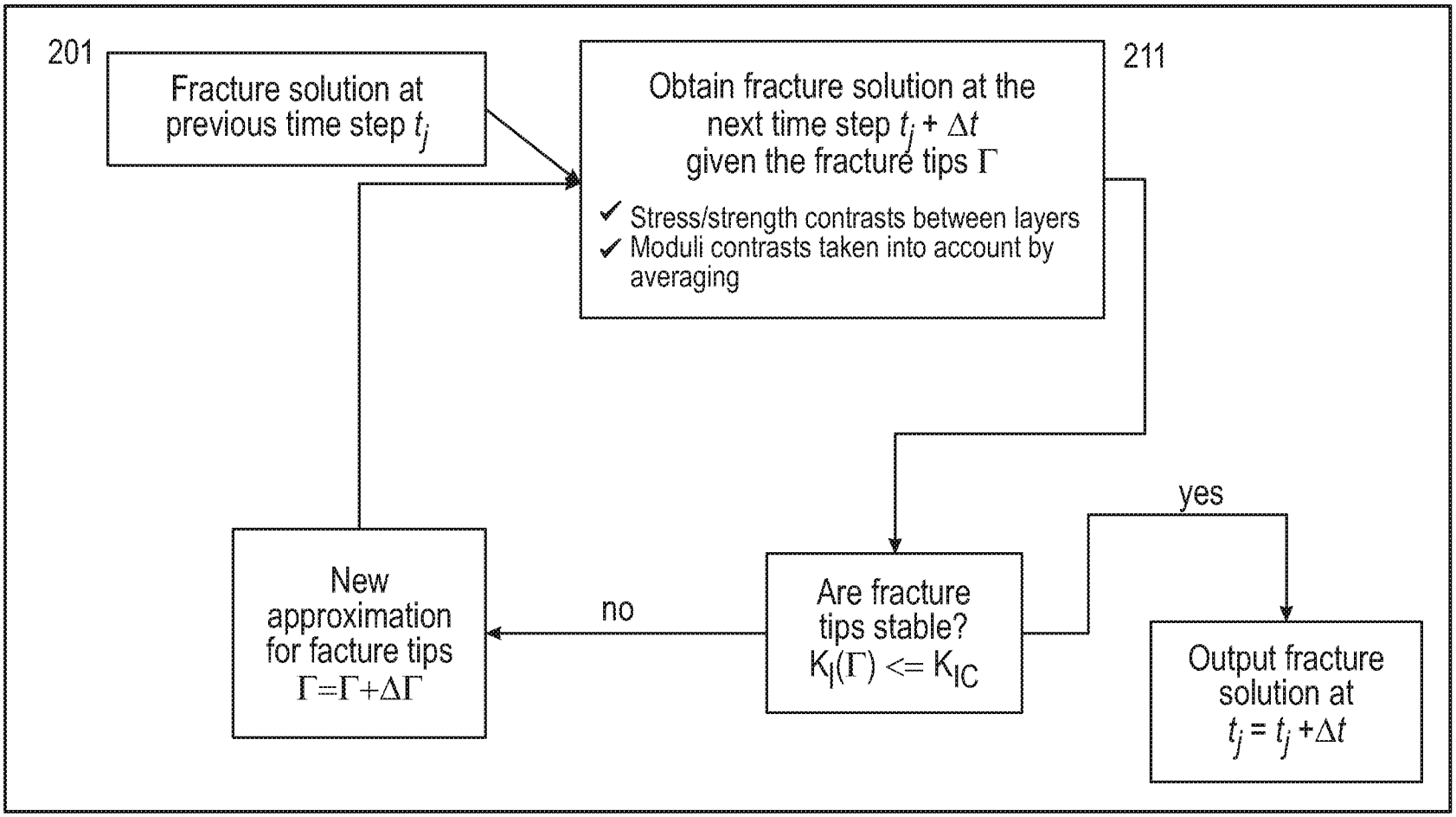

FIG. 18 shows fracture tip propagation (top) and inlet pressure decline (bottom) in the case of an elliptical fracture with Newtonian fluid with viscosity of 1 cP (left) and 10000 cP (right), respectively FIG. 19 is a flow chart of a component of a method for an embodiment (solver for hydraulic fracture tip propagation in the absence of interfaces).

Figure 20:
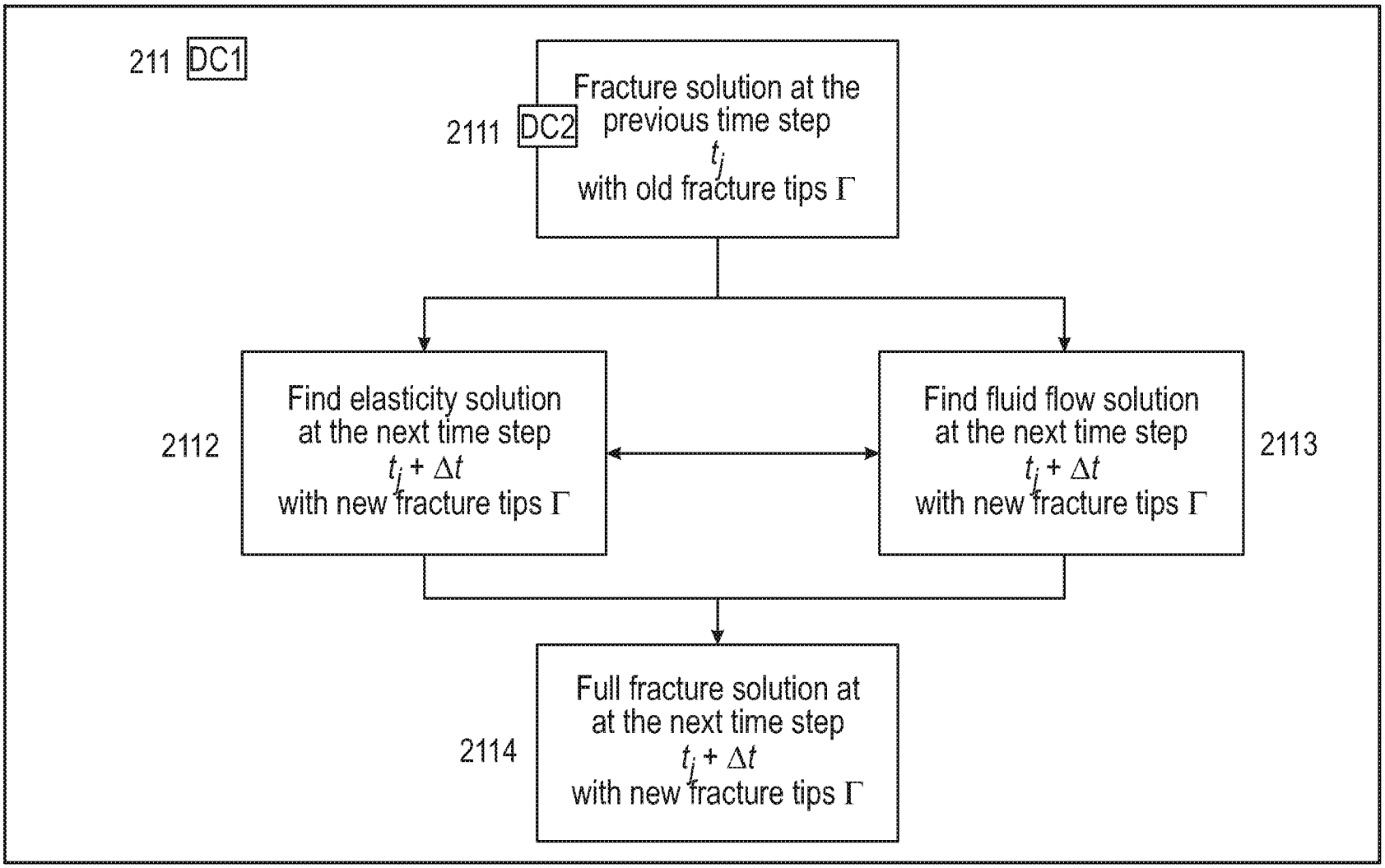

FIG. 20 is a flow chart of a component of a method for an embodiment (sub-component of the above: a coupled solid-fluid solver for hydraulic fracture with given fracture tip position).

Figure 21:
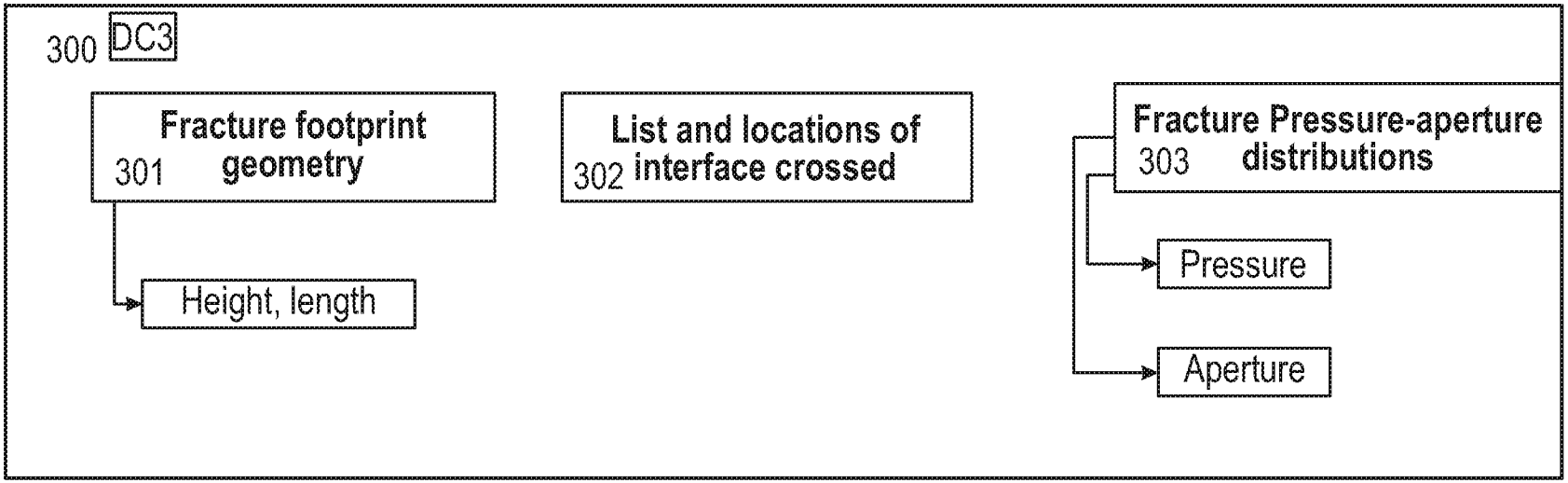

FIG. 21 is a flow chart of outputs of an embodiment of a method.

SUMMARY

Embodiments herein relate to a method for hydraulic fracturing a subterranean formation traversed by a wellbore including characterizing the formation using measured properties of the formation, including mechanical properties of geological interfaces, identifying a formation fracture height wherein the identifying comprises calculating a contact of a hydraulic fracture surface with geological interfaces, and fracturing the formation wherein a fluid viscosity or a fluid flow rate or both are selected using the calculating. Embodiments herein also relate to a method for hydraulic fracturing a subterranean formation traversed by a wellbore including measuring the formation comprising mechanical properties of geological interfaces, characterizing the formation using the measurements, calculating a formation fracture height using the formation characterization, calculating an optimum fracture height using the measurements, and comparing the optimum fracture height to the formation fracture height.

DETAILED DESCRIPTION

Herein, we provide an approach to predict hydraulic fracture height growth in rocks having laminated structure. This method includes (i) a preliminary vertical characterization of the bulk rock mechanical properties, the mechanical discontinuities and in-situ stresses, and (ii) running the computational model of 3D or pseudo-3D hydraulic fracture propagation in the given layered rock formation and taking into account the interaction with the given weak mechanical and/or permeable horizontal interfaces. Methods herein for rock characterization and advanced fracture simulation produce a more accurate prediction of a fracture height growth, fracturing fluid leak-off along weak interfaces, forming T-shaped fracture contacts with horizontal interfaces, and switching from vertical orientation of the fracture to a horizontal one.

3 mechanisms that control height growth are described in more detail below.

1. Mechanism 1 (conventional): minimum horizontal stress variation as a function of depth called "stress contrast"
2. Mechanism 2 (conventional): elastic moduli contrast between adjacent and different lithological layers called "elasticity contrast"
3. Mechanism 3 (most important, it is the novelty of this application): weak mechanical interface between similar or different lithological layers called "weak interface"

a. Sub-mechanism 3a: elastic interaction, crossing criterion and re-initiation past-interface b. Sub-mechanism 3b: enhanced leak-off of the fracturing fluid into the interface Characterization of Vertical Rock Texture In order to make the prediction of fracture height growth precise, information about rock properties, its mechanical discontinuities, and in-situ stresses is required. Information about rock comprises the detailed vertical distribution of mechanical properties of the rock mass, including variation of rock strength, in terms of, for example, tensile strength, compressive strength (e.g. uniaxial confined strength or UCS) and fracture toughness, which should provide information about placement of weakness planes in rock with elastic properties (e.g. Young modulus and Poisson's ratio). Measurement of rock stresses should bring information about the vertical stress and the minimum horizontal stress in the normal stress conditions, where vertical stress component is the largest compressive stress component (or strike-slip conditions where the vertical stress is the intermediate compressive stress component).

There are available rock property characterization tools that can be used for mechanical rock property measurement. These are Sonic Scanner, and image logs (e.g. REW: FMI, UBI; OBMI; e.g. LWD: MicroScope, geoVISION, EcoScope, PathFinder Density Imager), which can give information about elastic properties and locations of pre-existing interfaces. If coring is available, in the lab test one can perform heterogeneous rock analysis (HRA) on cores extracted from this rock mass, and scratch test, which provides information about statistical distribution of weakness planes on a core scale and their properties (tensile and compressive strength, fracture toughness).

In summary, the input properties to be characterized are:

Density (i.e. inverse of spacing) and orientation (mainly horizontal) of weak interfaces as a function of depth Mechanical and hydraulic properties of the weak interfaces (respectively, friction, cohesion, tensile strength, and toughness, and permeability and filling)

Vertical stress (Sv) as a function of depth

Minimum horizontal stress (Sh) as a function of depth

Elasticity of bulk rock (e.g. Young Moduli and Poisson Ratio) as a function of depth Chart 1 provides an inventory of data sources and model parameters for a given type of rock and reservoir. SONIC-SCANNER™ and ISOLATION SCANNER™ tools are commercially available from Schlumberger Technology Corporation of Sugar Land, Tex.

| Model parameter | Refers to | Potential data source |
|---|---|---|
| Vertical profile of rock layers and interfaces | | High Res petrophysics, image and sonic logs |
| E' - Young modulus (plain-strain) | LAYER | Sonic Scanner or Isolation Scanner logs |
| $K_{IC}$ - fracture toughness | | HRA including high res sonic and lab toughness |
| $T_0$ - tensile strength | | HRA including high res sonic and lab tensile strength |
| $\sigma_h$ - min horizontal stress | | Calibrated MEM (sonic, MDT stress) |
| $\sigma_v$ - overburden stress | | Density logs |
| $p_P$ - pore pressure | | Known from local field knowledge or measurements |
| $\lambda$ - coefficient of friction | INTERFACE | Lab measurements on cores or correlation to sonic |
| $K_{IIC}$ - fracture toughness (Mode II) | | Lab measurements on cores or correlation to sonic |
| $w_{int}\ \kappa_i$ - conductivity in intact zone | | Lab measurements on cores |
| $w_{int}\ \kappa_s$ - conductivity in activated zone | | Lab measurements on cores |

Figure 5:
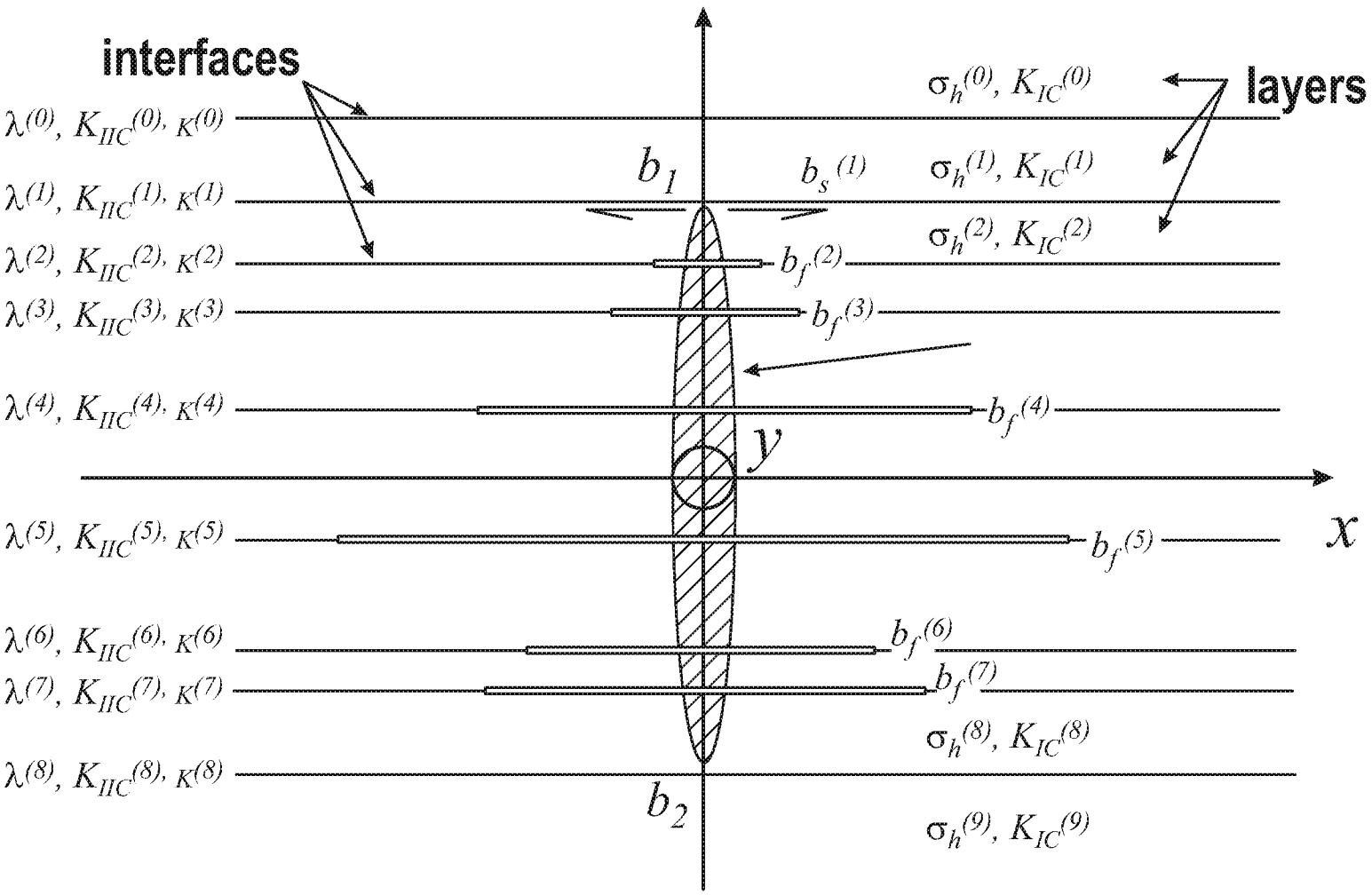
FIG. 5 is a schematic drawing of a vertical hydraulic fracture (HF) growth in a subterranean layered rock with horizontal interfaces.

FIG. 5 is a schematic drawing of a vertical hydraulic fracture (HF) growth in a subterranean layered rock. The HF propagates vertically (in the slide plane) and laterally (across the slide plane) by pumping of a fracturing fluid (in gray) from the well. Vertical propagation takes place upward and downward and characterized by the coordinates $b_1$ and $b_2$ respectively. The height growth in both sides is affected by the mechanical properties of the rock layers where the fracture tips are (e.g. fracture toughness), confining rock stresses, and hydromechanical properties of the interfaces between the adjoining layers (e.g. friction coefficient, fracture toughness, hydraulic conductivity). The HF propagation is associated with the leak-off of a fracturing fluid from the HF along the hydraulically conductive interfaces.

Figure 6:
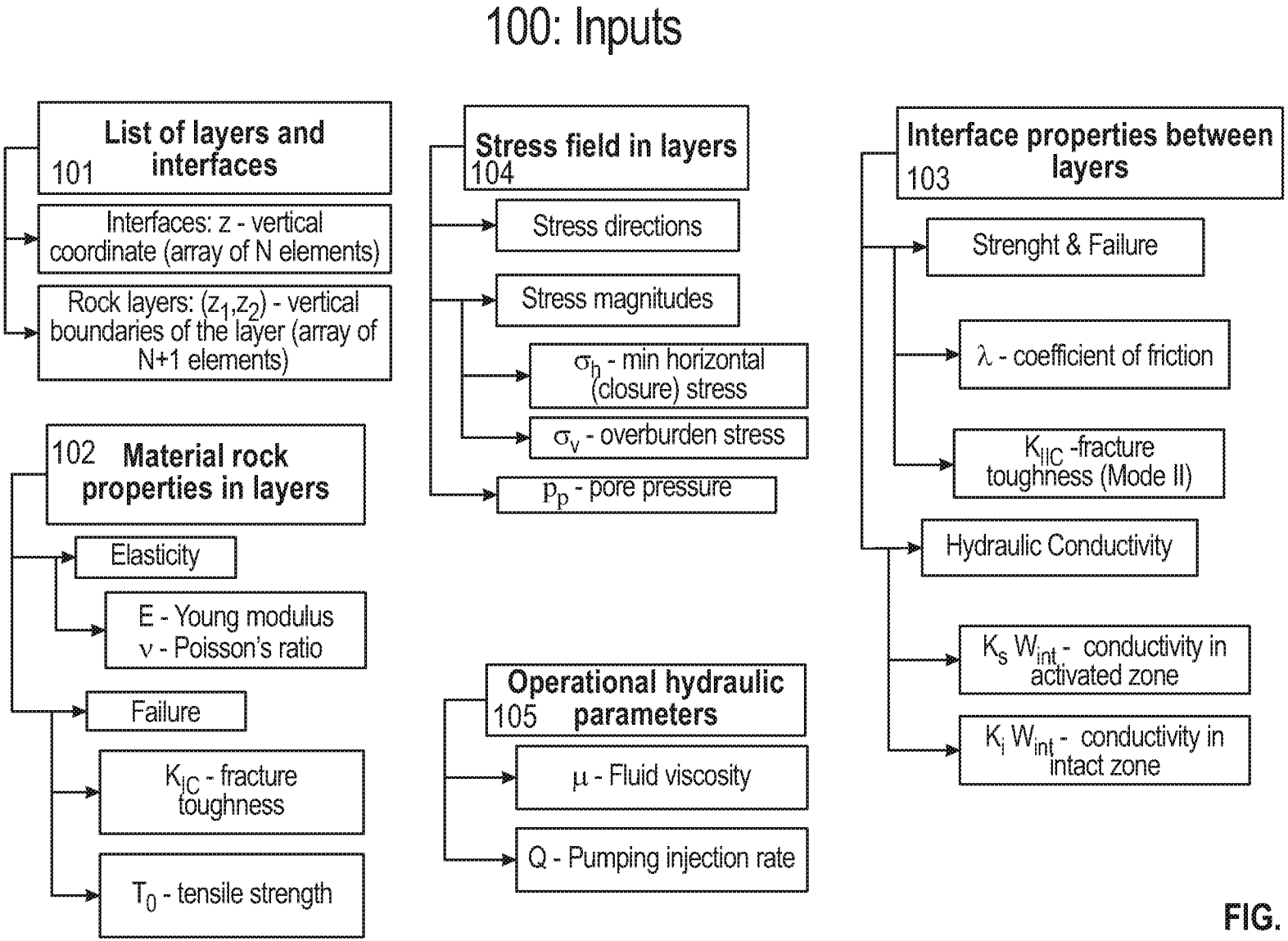
FIG. 6 is a flow chart listing the information that may be used for an embodiment herein.

FIG. 6 gives detailed overview of the families of input parameters and the names of every parameter in the family required for the HF simulator.

Next, a discussion of a framework is needed. There are three main mechanisms related to the limitation of the HF growth in height: (i) the contrasts of the rock stresses and strengths between the adjoining rock layers ("mechanism 1" as introduced above), (201), (ii) the enhanced leak-off of the fracturing fluid into the bedding planes, presented here by the physical model ILeak (202) (sub-mechanism of "mechanism 3" as introduced above), and (iii) the elastic interaction with weakly cohesive slipping interfaces, presented here by the physical model FracT (203) (sub-mechanism of "mechanism 3" as introduced above).

FIG. 7 presents an example of sequential HF growth in height affected by the interaction with weakly cohesive and conductive interfaces. The uniform HF growth is temporarily arrested by direct contact of the fracture tips with the upper and lower interfaces, meanwhile continuing its propagation laterally. After some delay of the HF tips at the interfaces, the HF reinitiate its vertical growth across them. The stages follow.

Radial fracture: equal propagation in all directions

Tips reach interface

Vertical tips are temporarily arrested, horizontal tips continue to grow

Fracture breaks interface and propagate vertically

FIG. 8 demonstrates the HF height growth design workflow at a high level. It includes the input of the pre-given measured or estimated rock and interface properties on the one hand, and the input of the controlling parameters of the HF pumping schedule, on the other hand. They feed the model of the HF growth simulation (000), which is explained below. The results of the simulation go to the comparing module to find out the deviation of the simulated fracture height with respect to the optimum one. Depending on the tolerance of the fracture height growth obtained in the simulation, it either adjusts the fluid pumping parameters for the next cycle of the HF simulation, or outputs the used pumping parameters, which produce the optimum HF height in the given rock.

Next, we discuss modeling of fracture propagation in a vertically heterogeneous layered medium. The implying fracture model has to provide a solution for the coupled system of equations for the mechanical response of the rock surrounding the fracture and viscous fluid flow injected into the fracture. It should be assumed that the finite strength of the rock and continuing fluid flow into the fracture will result in the propagation of the fracture tips (a contour in 3D geometry) and the injected fluid within the rock mass. Used equations describing the mechanics of both rock solid response and fluid flow within the fracture must be principally three-dimensional in order to account for the fracture growth in horizontal and vertical directions. Coupling of fracture propagation in both directions with the injected fluid volume will allow assessing fracture height containment in rock for the industrial volumes of injected fluid.

Fracture model must take into account not only different stress and rock properties in different rock layers, but also interaction of the fracture tips with planes of weakness, such as bedding planes and lamination interfaces. It should be assumed that mechanical interaction of the hydraulic fracture with these interfaces can inevitably lead to creating zones of enhanced hydraulic permeability along these interfaces and significant fracturing fluid leak-off. Effect of weakness planes and enhanced interface permeability should be the key components of the intended computational model of fracture propagation in layered formations.

Herein, we develop an extensive analytical model of hydraulic fracture interaction, crossing and subsequent growth across weak horizontal interfaces in the limiting case of low-viscous fluid friction (toughness-dominated regime). The latter is justified provided that the vertical fracture tip propagation velocity is reduced. We evaluate modified mechanical characteristics of a fracture such as net pressure, opening (width) and slippage zone extent when the fracture is deflected by an interface. Evaluation of the condition for crossing of the interface gives rise to finding out time delay of fracture termination at the interface. Overall picture of the intermittent character of fracture growth through a series of weakness planes is further used in the fluid-coupled description of fracture propagation in height in both plain-strain and three-dimensional elliptical fracture geometries.

Construction of effective fracture propagation model in a finely laminated medium leads to the model of anisotropic medium with different fracture toughness in the vertical and horizontal directions. We estimate the aspect ratio of the length and height of the elliptical fracture in such medium for the given frictional and cohesional properties of the interfaces. The other mechanisms of fracture containment caused by the stress and rock property contrasts between layers can be applied on top of this model to use it in the modern fracture simulation tools.

FIG. 9 explains the conceptual structure of the HF simulator (000). It consists of the input (100), explained in more detail above, simulation engine (200), and output (300). The simulation engine and output are explained in more detail below. FIG. 10 depicts an embodiment of an algorithm of the HF simulator (200) workflow from the beginning of the fracturing job $t_0$ up to the end T. Every subsequent time step the fracture propagation problem is solved conventionally (201) such as there is no interaction with interfaces in the rock. Next, provided that the HF has contacted or crossed any rock interfaces the fracturing fluid leakoff module ILeak (202) is called to update the HF fluid volume, flowrate, and fluid pressure variations within the HF and infiltrated interfaces. Next, if the HF tip reaches any interface, the FracT module (203) is assessing the potential fracture tip arrest or crossing of the interface at the given time step. If the fracture tip is arrested, it remains non-propagating for the next time step. Otherwise, if the HF is crossing the interface or not contacted, it increments its length and goes to the next time step.

The ILeak module (202) will be explained with more detail as follows. The input information includes the interface, contact pressure, fluid viscosity, and time step. The module operates at every change in time for all contacted or crossed interfaces. The module assumes no elastic interaction and that there is leakoff of fracturing fluid in the interfaces. The module computes the increment of fluid percolation with the given interface for a change in time and provides the fluid front, leaked off volume, and the flow rate into the interface.

Consider an orthogonal junction of the vertical hydraulic fracture and a horizontal interface. The interface of finite thickness $w_{int}$ is filled by a permeable material. The intrinsic permeability of the filling material in intact interface parts is $\kappa_i$. Suppose that a certain segment of the interface, $-b_s<x<b_s$, nearby the junction is activated by shear displacement as a result of mechanical interaction with the hydraulic fracture. It results in the damage of the filling material within this segment and a change of its permeability to $\kappa_s$ (FIG. 11). FIG. 11 shows the horizontal interface crossed by the vertical hydraulic fracture (top), and schematic distribution of the percolated fluid pressure along the interface (bottom).

In tight formations $\kappa_i$ can be negligibly small. This condition $\kappa_i=0$) can be used later on to simplify the leak-off model. On the contrary, the activated part of the interface can be substantially more permeable than the intrinsic part due to the crushed grains of the filling material or shear dilation. Sliding activation of mineralized interfaces can be a dominant mechanism for the fracturing fluid leak-off in ultra-low permeability tight rocks.

Let us assume that the fracturing fluid flow along a permeable interface is one-dimensional, steady and laminar. In these conditions it can be described by the following Darcy law $$q(x) = -w_{int}\frac{\kappa}{\mu}\frac{dp}{dx} \tag{1}$$

where q(x) is the 2D rate of fluid percolation within the material of permeability $\kappa$, $\mu$ is the viscosity of the fluid, and p(x) is the fluid pressure distribution along the interface (FIG. 11, bottom). It is sometimes convenient to replace the product $w_{int}\kappa$ by the hydraulic conductivity of the interface c, typically measurable in laboratory (and use $c_s$ and $c_i$ notations hereafter, respectively).

The total rate of the fracturing fluid leak-off from the hydraulic fracture into the particular interface at the junction point $q_L$ is doubled due to symmetrical fluid diversion into both sides of the interface $$q_L=2(0) \tag{2}$$

Due to the symmetry of the fluid percolation in both sides of the interface, in what follows we obtain the solution only for the positive OX direction (x>0). The Darcy law (1) establishes relationship between the local flow rate q and associated fluid pressure decay dp/dx at every point of a permeable material infiltrated by fluid. We write this law first for the flow rate $q_s$ and pressure decay $p_s$ within the activated (sheared) part as $$q_s(x) = -\frac{c_s}{\mu}\frac{dp_s(x)}{dx},\ x \le \min(b_f, b_s) \tag{3}$$

and for the fluid rate $q_i$ and pressure $p_i$ within the intact part of the interface $$q_i(x) = -\frac{c_i}{\mu}\frac{dp_i(x)}{dx},\ b_s < x < b_f \tag{4}$$

where $b_f$ is the front of percolated fluid. Outside of the zone of penetrated fluid we assume the in-situ pore pressure condition, i.e.

$$(x)=0,\ (x)=p_p,\ x \ge b_f \tag{5}$$

The solution must include the position of the percolated fluid front $b_f$ and the pressure profile (x) at every time of the leak-off process.

From the fluid mass balance equation written for incompressible fluid within an interface with impermeable walls (except at the junction point)

$$\frac{\partial(\phi w_{int})}{\partial t} + \frac{\partial q}{\partial x} = 0 \tag{6}$$

where $\phi$ is porosity of the filling material or natural interface asperities, $q=q_s(x)$ for $x \le b_s$ and $q=q_i(x)$ for $x>b_s$, it follows that if the width $w_{int}$ is constant ($dw_{int}/dt=0$), the flow rate q has uniform value along the interface coordinate being only a function of time, i.e.

$$(x,t)=(x,t)=q(x,t)=\mathrm{const}(t) \tag{7}$$

Taking into account (7) and boundary condition (5) at $x=b_f$, the solution of (3)-(4) for the distribution of the percolated fluid pressure (x) along the interface indicates a linear decay shown in FIG. 12. FIG. 12 provides a profile of fluid pressure along the interface for the "in-slip" (top) and "out-of-slip" (bottom) regimes of percolation.

The solution for the pressure profile is written separately for two regimes of fluid percolation into the interface: "in-slip" percolation, when the leaked fluid is totally contained within the slipped zone of the interface, i.e. $b_f \le b_s$, and "out-of-slip" percolation into the intact interface zone also, i.e. $b_f > b_s$. For the "in-slip" leak-off (FIG. 12, upper), we obtain the following linear pressure profile $$p(x) = p_c - \left(\frac{\mu}{\kappa_s}\dot{b}_f\right)x = p_c - \left(\frac{p_c - p_p}{b_f}\right)x,\ x \le b_f \le b_s \tag{8}$$

where $p_c=p(0)$ is the fluid pressure at "contact" with a hydraulic fracture, i.e. x=0. For the "out-of-slip" leak-off (FIG. 12, lower), we obtain the following broken line profile $$p(x) = p_c - \left(\frac{\mu}{\kappa_s}\dot{b}_f\right)x = p_c - \left(\frac{p_c - p_1}{b_s}\right)x,\ x \le b_s \le b_f \tag{9}$$

$$p(x) = p_1 - \left(\frac{\mu}{\kappa_i}\dot{b}_f\right)(x - b_s) = p_1 - \left(\frac{p_1 - p_p}{b_f - b_s}\right)(x - b_s),\ b_s < x < b_f \tag{10}$$

where $p_1=p(b_s)$ is the fluid pressure at the slippage zone tip. In (8)-(10) we take into account that $$q=\phi w_{int}\dot{u}=\phi w_{int}\dot{b}_f \tag{11}$$

where $\dot{u}$ is the lengthwise fluid velocity (upper dot stands for the differentiation with respect to time) equal to the velocity of the percolated fluid propagation $\dot{b}_f$. Therefore, from (8)-(10) we obtain the following ordinary differential equations for the propagation of the fluid front (t) right after the contact ($t>t_c$) for "in-slip" fluid penetration:

$$\dot{b}_f(t) = \frac{\kappa_s}{\mu}\frac{p_c(t) - p_p}{b_f(t)},\ b_f \le b_s \tag{12}$$

and for "out-of-slip" penetration:

$$\dot{b}_f(t) = \frac{\kappa_s}{\mu}\frac{p_c(t) - p_1(t)}{b_s} = \frac{\kappa_i}{\mu}\frac{p_1(t) - p_p}{b_f(t) - b_s},\ b_f > b_s \tag{13}$$

where the fluid pressure at the slip zone tip $p_1=p(b_s)$ is found as $$p_1 = p_p + (p_c - p_p)\frac{b_f - b_s}{b_f - (1 - \kappa_{is})b_s}h(b_f - b_s) \tag{14}$$

where $\kappa_{is}=\kappa_i/\kappa_s$, and H(x) is the Heaviside step function (zero for negative, and one for positive arguments respectively).

The solution of (12)-(13) is found for both regimes of fluid penetration as follows $$b_f(t) = b_{f1}(t) = \sqrt{\frac{2\kappa_s}{\mu}\int_{t_c}^{t}\Delta p_c(t')\,dt'},\ b_f \le b_s \tag{15}$$

$$b_f(t) = \sqrt{\kappa_{is}(b_{f1}^2(t) - (1 - \kappa_{is})b_s^2)} + (1 - \kappa_{is})b_s,\ b_f > b_s \tag{16}$$

where $t_c$ is the time at the beginning of the fracture-interface contact, $\Delta p_c(t')=p_c(t')-p_p$ is the differential fluid pressure at the interface. The evolution of the differential pressure with time therefore dictates the leak-off process in the given contacted interface.

Consider a vertical plane-strain fracture pumped by a constant injection rate and growing symmetrically upward and downward in a homogeneous rock. Let a permeable interface be placed at some distance $y=h_c$ from the injection point y=0. Once the height of the fracture reaches $h=h_c$, the fluid begins to percolate into the interface. At time $t=t_c$, the fracture may stop or continue growing with given leak-off as shown in FIG. 13. FIG. 13 shows hydraulic fracture propagating upward and downward in plane-strain geometry (vertical cross-section). There are three distinct stages: (left) pre-contact with growing fracture without leak-off, (middle)

early contact with non-growing fracture with leak-off, and (right) late contact with growing fracture with leak-off.

We will suppose that prior to a direct contact with an interface at $t=t_c$ the hydraulic fracture propagates without any elastic or hydraulic interaction. The remotely placed permeable interface is not mechanically activated due to the approaching fracture and thus it does not change the stress state around. Before the contact, the injected fluid is totally contained within the fracture, as the medium is supposed impermeable. Right after the contact with the interface ($t=t_c$), the fluid flows within the interface and causes a loss of fluid volume stored in the hydraulic fracture. The fracture continues grow once the fluid volume loss is compensated by the injected volume at a later time $t=t_r>t_c$. We provide a detailed example of the mechanics of the fracture propagation affected by the presence of a hydraulically conductive interface on the path of its height growth on FIG. 14.

FIG. 14. The injected, fracture and leaked-off fluid volumes (top), net pressure (middle), and hydraulic fracture halfheight (bottom) during the whole cycle of fluid injection into the fracture. The left time region shaded in blue is the pre-contact stage. The middle time region shaded in orange is the early contact stage. The right time region shaded in green is the late contact stage. At the very beginning (in blue shaded time stage) the hydraulic fracture propagates without interaction and leak-off. The net pressure decline and fracture height growth follow the expected behavior. Right after the contact with a permeable plane (yellow shaded time stage), the leak-off starts following the known asymptotic behavior. Initially it dominates over the injection as predicted from leak-off equation above, and the fracture fluid volume v partly drops. The rate of leak-off into the interface gradually reduces with time of percolation. During the early contact stage the leakoff rate becomes smaller than the injection rate into the fracture. This restores the fluid volume increase within the hydraulic fracture that it had lost at the moment of contact. When the fluid volume losses due to the leak-off are totally compensated by the postcontact injection into the fracture, the critical net pressure is achieved within the fracture again and it reinitiates its vertical growth (green shaded time region). At a late contact stage, the fracture growth takes place with continuing leak-off. The rate of fracture volume pumping is therefore less than it was before contact, so the decay of net pressure and velocity of fracture height growth are also smaller. If the leak-off takes place only into one interface, the rates of fracture growth will return back to initial values with time when the leak-off becomes negligibly small, and can be fully neglected in simulations.

Next, we discuss the methods, inputs, and outputs of the FracT module (203). The inputs include the upper or lower tip coordinates, pressure profile, formation layers and interfaces, and the index of the interface at a T-shaped contact. The module provides a slip boundary, residual slip, and interface state of intact, T-shaped, or crossed. The FracT module is called for every interface at a T-shaped contact with the fracture tip and includes elastic interaction and crossing criterion and re-initiation past-interface.

Consider the vertical cross-section of a hydraulic fracture growing in height (FIG. 15, left). Suppose that both fracture tips simultaneously reach two pre-existing horizontal interfaces above and below. After the contact, the interfaces slip and arrest further fracture tip propagation in the vertical direction (FIG. 15). FIG. 15 provides a two-sided contact of a vertically growing fracture and weak horizontal interfaces (left), interface activation, and fracture tip blunting as a result of the contact with the interfaces (right).

At the point of contact, the problem becomes the one of the orthogonal contact between a pressurized fracture and two weak interfaces, shown in FIG. 15 (right). To solve this problem, we first need to obtain the modified fracture characteristics such as the fracture volume, the opening (width), the blunting characteristics of the tip, the extent of the interfacial slip zone $b_s$, and the associated drop of the net pressure within the fracture after the contact. Next, we need to evaluate the minimum buildup of net pressure necessary to cross the interfaces. This criterion of interface crossing can then be used, for example, in rigorous 3D fracture propagation models, where it will quantify the time delay of the fracture height growth due to interfacial contacts (i.e. from the moment of fracture contact with the interface and its arrest to the subsequent crossing of the interface to continue the propagation).

The problem of an elasto-frictional fracture contact can be solved rigorously numerically. Here, we use an approximate analytical solution of this problem, described in more detail in SPE-173337, "Hydraulic Fracture Height Containment by Weak Horizontal Interfaces," February 2015, by Dimitry Chuprakov and Romain Prioul, which is incorporated by reference herein. The analytical model facilitates parametrical insights into the fracture contact problem. We focus on the following characteristics of the fracture-interface contact: (i) the extent of the interface activation in shear $b_s$, (ii) the associated hydraulic fracture opening $w_T$ (width) at the junction with the interface, and (iii) the post-contact fracture volume V in the vertical cross section. These characteristics are found to be functions of the fracture net pressure p', the critical shear stress at the slipping part of the horizontal interface $\tilde{\tau}_m$, the interface fracture toughness $\kappa_{IIC}^{(INT)}$, and the half-height of the pressurized vertical fracture L. To facilitate the formulation of the problem in dimensionless form, we introduce the relative length of the interface activation $\beta_s=b_s/L$, the modified fracture opening at the contact $\Omega_T=w_T E'/4$, and the modified fracture volume $v=VE'/(2\pi)$, where $E'=E/(1-\nu^2)$ is the modified planestrain Young modulus, and they can be expressed as $$\beta_s=(\Pi,\kappa_{IIC}),\ \Omega_T=\Omega_m\overline{\Omega}(\Pi,\kappa_{IIC}),\ v=v_0\overline{v}(\Pi,\kappa_{IIC}) \tag{17}$$

where $v_0=p'L^2$ is the modified fracture volume, and $\Omega_m=p'L$ is the maximum modified fracture opening at the middle of the fracture prior to contact. The two dimensionless parameters are the relative net pressure $\Pi=p'/\tau_m$ and the dimensionless interface toughness $\kappa_{IIC}=\kappa_{IIC}^{(INT)}/(\tau_m\sqrt{\pi L})$, where $\tau_m=\lambda\sigma'_V$, $\lambda$ is the coefficient of friction, and $\sigma'_V=\sigma_V-p_{int}$ is the effective vertical stress at the interface with interstitial fluid pressure $p_{int}$. Initially, $p_{int}$ equals the pore pressure; after fracturing fluid penetration into the interface, it represents the pressure of the penetrated fluid.

The magnitude of the relative net pressure $\Pi$ defines the magnitude of these characteristics. The size of the interface activation monotonically increases with $\Pi$. It is small when the net pressure p' is small or frictional stress $\tau_m$ is large. In most practical cases, when the net pressure is small relative to the frictional stress ($\Pi=p'/\tau_m<<1$), the activated zone obeys the following asymptote $$\beta_s \cong \frac{\pi^2}{8}(\Pi-\kappa_{IIC})^2 \tag{18}$$

In the opposite limit of relatively high net pressures ($\Pi >> 1$), we arrive at the following linear asymptote $$\beta_s \cong \frac{2}{\pi}\Pi \tag{19}$$

A similar trend is observed for the fracture opening (width) $\overline{\Omega}_T = \Omega_T/\Omega_m$ at the junction. The fracture tends to close at the contact with the interface, if $\Pi - \kappa_{IIC} << 1$, following the asymptote $$\overline{\Omega}_T \cong \frac{\pi}{4}\frac{\Pi^2 - \kappa_{IIC}^2}{\Pi} \tag{20}$$

In the opposite limit ($\Pi >> 1$), the opening at the junction is of the same order of magnitude as the maximum opening, $\Omega_m$. It changes logarithmically with $\Pi$, as follows $$\overline{\Omega}_T \cong \frac{2}{\pi}\ln\left(\frac{2}{\pi}\Pi\right) \tag{21}$$

In the case of simultaneous fracture contact with two weak interfaces, the profile of the fracture opening widens as a function of $\Pi$ as shown in FIG. 16 (left). FIG. 16 provides profiles of the vertical fracture opening at the contact with two cohesionless interfaces (grey) for the relative net pressure $\Pi$ equal to 0.1 (black), 1 (blue), and 10 (red) (left), and the relative net pressure $\Pi$ in the fracture prior to (dashed line) and after (solid lines) the contact with interfaces versus the normalized fracture volume $\nu/(\tau_m L^2)$ for the case of two-sided fracture contact (right). Black lines represent the normalized fracture toughness along interfaces $\kappa_{IIC}=0$, and red lines are for $\kappa_{IIC}=0.1$. Blue arrows denote associated pressure drop within the fracture at the moment of contact with interfaces.

The larger the relative net pressure $\Pi$, the wider fracture opens along the entire vertical cross section, as expected. The effect of interfaces on the elastic fracture opening resembles a sudden change of the elastic compliance of the rock. Indeed, the weakness planes represent two compliant planes in a stiff rock. When the fracture establishes contact with them, it is obvious that the elastic response of the fracture must become more compliant. This effect of abrupt fracture widening at the moment of contact with weak interfaces may result in an abrupt drop of the fracture pressure. Fast increase of the fracture volume must lead to an associated fast decrease in the fluid pressure. We performed additional investigations of the net pressure drop at the moment of the fracture contact with two weak interfaces. FIG. 16 (right) shows the magnitude of the relative net pressure drop for the given volume of injected fluid within the fracture immediately prior to the contact with the interfaces. When the relative net pressure is small ($\Pi < 1$), the pressure drop is small and not detectable. For large relative net pressures ($\Pi > 1$), the pressure within the fracture drops noticeably. Herein, the fracture opening profile is found as a part of the problem solution.

Fracture Reinitiation Problem: Crossing of the Interfaces.

The interface activation generates a localized tensile stress field on the opposite side of the interface (FIG. 17). High tensile stresses are concentrated close to the junction point and can exceed tensile strength of the formation. In the most stress-perturbed region, the maximum principal tensile stress component is parallel to the interface. The contact-induced stresses favor the initiation of a new tensile crack in the intact rock in a direction normal to the interface (see arrows in FIG. 17). A similar problem has been solved analytically assuming uniform opening of the fracture. FIG. 17 includes the maximum tensile stress component generated on the opposite side of the cohesionless (left) and cohesional interface with $\kappa_{IIC}=1$ (right). Vertical and horizontal white solid lines depict the fracture and interface, respectively. White arrows point out local directions of the maximum principal compressive stress (perpendicular to the maximum principal tensile stress). The coordinate scales are all normalized on the extent of sliding zone $b_s$ To initiate a new crack and cross the interface, sufficient elastic strain energy must also be accumulated in the rock. Critical stress and critical elastic energy release are both required for crack initiation in solids. To use this mixed stress-and-energy criterion for the fracture reinitiation, we derive and evaluate the initiation stress intensity factor $K_{ini}$ within the critical stress zone as a function of the problem parameters. Then, we introduce the following crossing function, Cr, as the ratio of the initiation stress intensity factor $K_{ini}$ and the fracture toughness of the rock behind the interface $K_{IC}^{(2)}$, where the crack is to be initiated:

$$Cr = \frac{K_{ini}}{K_{IC}^{(2)}} = \frac{K_{IC}^{(1)}}{K_{IC}^{(2)}}\hat{C}r(\Pi, \kappa_{IIC}, \alpha) \tag{22}$$

where $\alpha = \sigma_h/\tau_m$ is the relative minimum horizontal stress $\sigma_h$ in the layer behind the interface. The crossing function Cr is greater than 1 if the crossing criterion is satisfied, otherwise the fracture is arrested at the interface. The contrast of fracture toughnesses on both sides of the interface, $K_{IC}^{(1)}/K_{IC}^{(2)}$ plays an important role as expected. The fracture growth into a weaker formation is less resistant as opposed to the growth into a stronger rock. We further consider a particular case of identical rock toughnesses on both sides of the interface ($K_{IC}^{(1)} = K_{IC}^{(2)}$). To understand the possible delay of the fracture tip growth at the interface, we investigate the dependence of the modified crossing function $Cr = C\hat{r}$ on the dimensionless parameters of the problem: $\Pi$, $\kappa_{IIC}$ and $\alpha$.

Consider the initial moment of the contact with the interface. It appears that for all values of the dimensionless parameters of the problem, the crossing function is initially less than 1. This means that interface can never be crossed straight away as a continuous fracture propagation process. The fracture tip is arrested by the interface until the net pressure builds up sufficiently to raise the value of crossing function to 1. One can understand this from a mechanical fracture energy perspective. The noninteractive fracture tip requires additional injected fluid energy to grow. Once the contact with the interface is established, part of the fracture energy is consumed into the energy required for the interface slippage. Therefore, the crossing of the interface requires more energy than is required in the noninteraction case. This explains the abrupt stop of the fracture tip at a weak interface.

The above results on the interface crossing pertain to the two-sided hydraulic fracture contact problem. In the considered examples, the fracture half height L is therefore assumed fixed after the contact. In the general case, the fracture can interact with only one interface while the other vertical fracture tip continues to grow. This general case has been solved using a similar technique and shows that containment at the interfaces will follow the same trends in net pressure behavior.

Intermittent Fracture Propagation Through Interfaces (LamiFrac Model)

Figure 1:
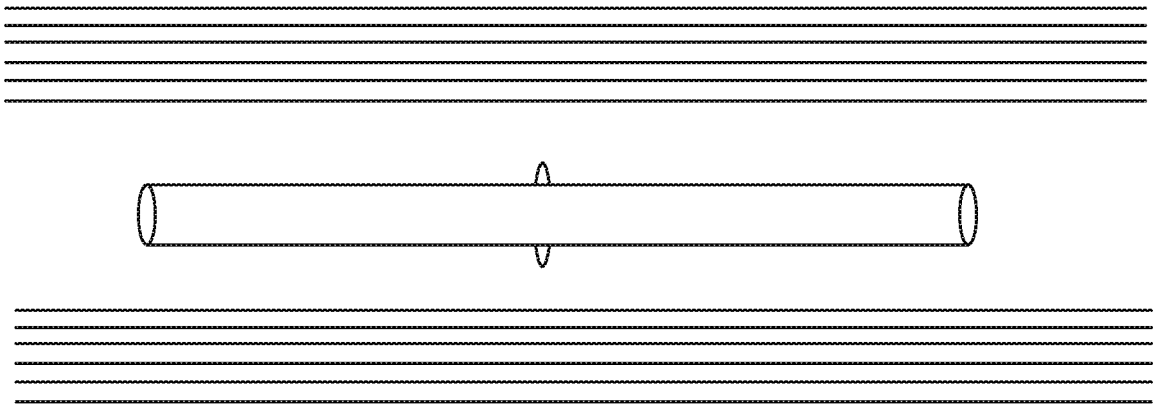
Figure 2:
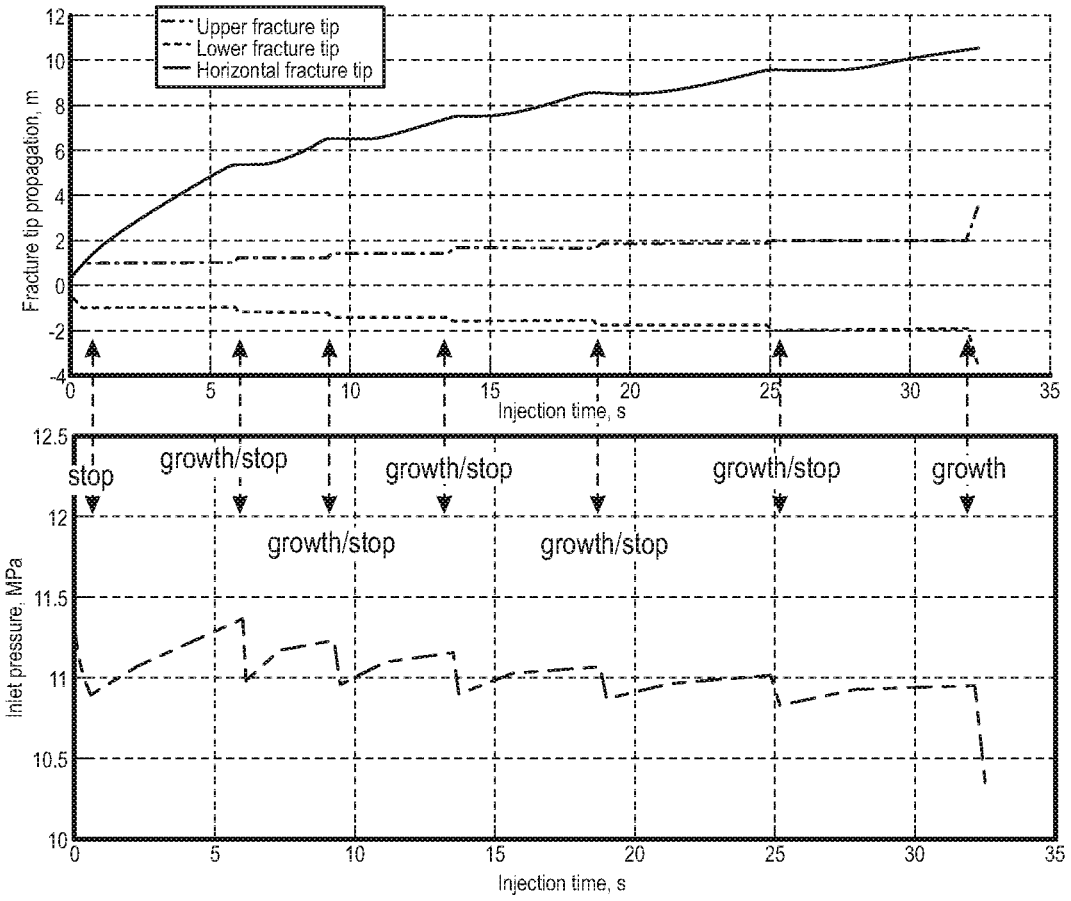
Figure 3:
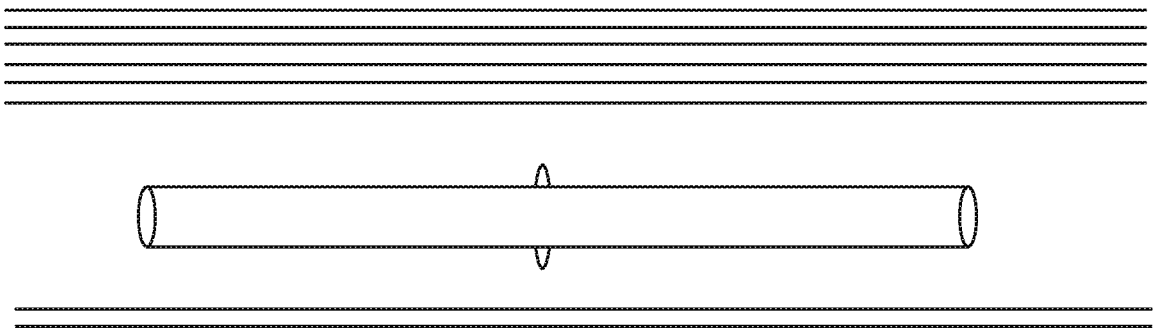
Figure 4:
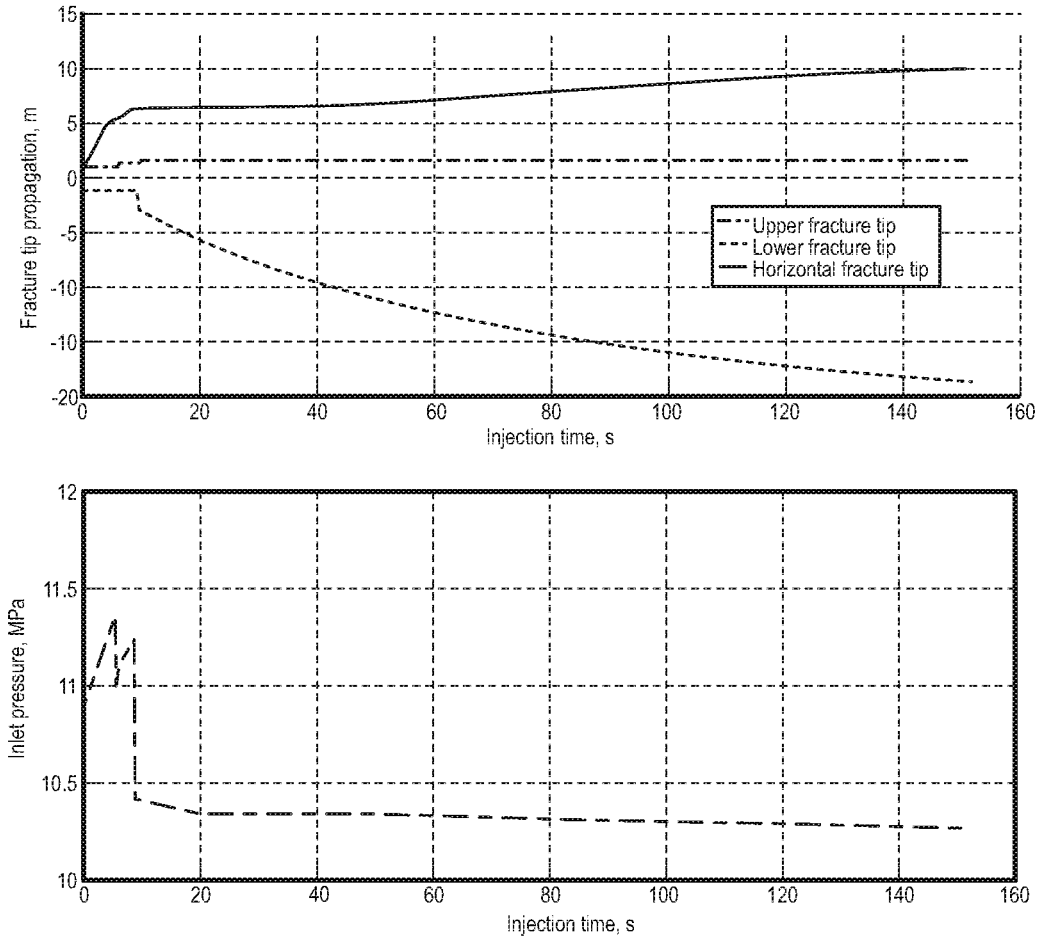

Next, we explore the impact of the previous mechanism on the 3D planar hydraulic fracture propagation from a horizontal well in a multilayer formation with horizontal weak interfaces on both sides of the well (we consider a symmetric case for simplicity, although the methodology is general). Within each layer, the stresses, rock elastic and strength properties do not change but they are allowed to vary between layers. The fracture propagation starts from a small circular fracture. Please refer back to FIG. 1 which illustrates the geometry of the layers and interfaces and the hydraulic fracture.

Initially the hydraulic fracture propagates equally in the upper vertical, lower vertical, and horizontal directions (i.e., as a radial fracture at the start). Then, following the contact with the interfaces, the propagation in the horizontal and vertical directions becomes different. For the sake of the demonstration, here we use an approximate solution of the 3D fracture problem based on the solution for an elliptical crack. The fracture geometry keeps an elliptical shape given the unequal growth in the three directions (two vertical and horizontal one). The modeling algorithm consists of three computational components. The first one computes the elastic fracture response to the injected fluid pressure and in-situ stress. It accounts for the fracture interaction with the interfaces as presented above. The second component solves for the simultaneous fracture tip growth in all three directions. The third component finds the fluid pressure within the fracture and all contacted interfaces, given the conditions for the fluid injection rate, the leakoff along the conductive interfaces, and the viscous fluid friction within the fracture. The latter obeys the known lubrication law for Newtonian fluids.

In the simulations, we first prescribe the parameters of the rock and fluid injection in the borehole. Then, we compute the evolution of the fracture propagation geometry for the prescribed conditions, which enables us to investigate the impact of the pre-existing horizontal interfaces on the fracture containment.

The qualitative picture of the fracture propagation looks similar in all simulations and can be described as follows. Once the vertical tips reach the upper and lower interfaces, their propagation stops for some time. The fracture still continues to propagate in the horizontal direction. At this stage, the net pressure in the fracture builds up (in similar fashion as one would observe in a PKN-type fracture). Once the net pressure has increased up to a critical value, the fracture has enough energy to break the interfaces. After the crossing of the interfaces, the fracture immediately contacts the next interfaces. As the fracture jumps vertically from one interface to another, the net pressure drops. As a result, the fracture growth temporarily ceases in all directions. Under further pressure increase, the fracture continues to grow in the horizontal direction again while it is still arrested in the vertical direction, and this growth leads to additional pressure buildup. The crossing of the interfaces and next cycle of pressure drop repeats itself. Such intermittent fracture propagation continues as long as the fracture interacts with horizontal interfaces.

FIG. 18 illustrates the described mechanics of the fracture tip propagation and the pressure oscillations. It shows the results of two simulations with small and large injected fluid viscosity (1 cP and 10000 cP, respectively). The spacing between the interfaces is 0.1 m. For simplicity, the rock and interface properties within each layer are identical in these runs. These simulations show (FIG. 18, top) that the hydraulic fracture's vertical growth is inhibited due to the presence of weak interfaces.

As a result, the fracture grows preferentially in the horizontal direction. The increased viscosity in the fluid injected into the fracture favors the interface crossing, which is well known. This explains why the containment effect is less prominent with larger fluid viscosity (FIG. 18, top right). FIG. 18 shows fracture tip propagation (top) and inlet pressure decline (bottom) in the case of an elliptical fracture with Newtonian fluid with viscosity of 1 cP (left) and 10000 cP (right), respectively. Constant rate of the fluid injection into the fracture is 0.001 $m^2/s$. The radius of initial fracture is 1 cm. Spatial spacing between horizontal interfaces is 0.1 m. The interfaces are cohesionless with the coefficient of friction 0.6 and pore pressure 12 MPa. Vertical in-situ stress is 20 MPa, minimum horizontal in-situ stress is 15 MPa. The fracture toughness of the rock is $K_{IC}$=1 MPa*$m^{1/2}$, tensile strength 5 MPa, E'=10 GPa.

In the limiting case of a finely laminated structure, the pressure oscillations and tip jumps become vanishingly small. The fracture growth then represents a continuous process. The description of the fracture propagation in these rocks can be similar to that in a homogeneous rock, with the only difference being that the fracture toughness in the vertical direction across the interfaces has an increased "effective" value. The envelopes of the pressure curves for an "effective" finely laminated structure with weak interfaces and a continuous homogeneous rock without interfaces are plotted in FIG. 18 (red and green curves, respectively). These pressure curves clarify the difference between the effect of the fracture toughness across a multilaminated/multilayered formation and the one without interfaces.

Using the model above, we obtain the "effective" fracture toughness for laminated formations. The steady fracture propagation criterion requires that the stress intensity factor $K_I$ at the tip equals the fracture toughness of the rock $K_{IC}$:

$$K_I = K_{IC} \tag{23}$$

In a laminated formation, the steady growth in height means that the vertical tip constantly crosses the infinitesimally close interfaces, so that Cr=1 (Eq. 22). Rewriting this equation in terms of the stress intensity factor at the vertical tip, we have $$K_I = K_{IC}^{(eff)} \tag{24}$$

where $K_{IC}^{(eff)} = K_{IC} K_I / K_{ini}$ is the "effective" fracture toughness. It is always larger than $K_{IC}$ and depends on the mechanical properties of the interfaces, such as cohesion, friction coefficient, and hydraulic conductivity. This result is in agreement with the laboratory measurements of in- and cross-layer toughness used in the previous models.

FIG. 19 builds a workflow for the conventional HF propagation solver (201) such as if there is no interaction with rock interfaces (but it includes the stress and strength constrast mechanism 1). The coupled solid-fluid HF solver (211) is called for every guessed increment of the fracture tip to output the solution for the stress intensity factor (SIF) $K_I$ at the HF tip. The SIF is then compared with the fracture toughness of the present rock layer $K_{IC}$ to find out if the fracture tip is stable or not. The loop is reinitiated every time unless the current increment of the HF tip is stable, and outputs the found solution.

FIG. 20 builds a workflow for the sub-component (211) of the HF propagation solver (201) above. It represents a coupled solid-fluid HF solver for the given placement of the HF tips. It takes the solution for the HF at the previous time step (2111), finds out the coupled solution of elasticity (2112) and fluid flow (2113) at the next new time step and new fracture tips, and outputs it (2114). The coupled solution for the elasticity (2112) and fluid flow (2113) requires additional iterations (horizontal arrow between 2112 and 2113).

FIG. 21 shows the output sub-modules of the main workflow (300 at FIG. 9). They are geometrical (301), e.g. HF height and length, informational about the affected rock interfaces (302), e.g. coordinates of the crossed interfaces and generated slips at each of them, and mechanical (303), e.g. fluid pressure and fracture aperture.

We claim:

1. A method for hydraulic fracturing a subterranean formation traversed by a wellbore, comprising:

characterizing the subterranean formation using measured properties of the subterranean formation, wherein the measured properties of the subterranean formation include mechanical properties of geological interfaces, and wherein characterizing the subterranean formation comprises characterizing a weak mechanical interface between adjacent lithological layers;

identifying a formation fracture height, wherein the identifying comprises iteratively calculating a respective fracture height growth using the subterranean formation characterization for each time step of a plurality of time steps to determine whether a formation fracture tip crosses the weak mechanical interface at a respective time step of the plurality of time steps, and wherein the iteratively calculating comprises identifying respective fracturing fluid properties that cause the formation fracture tip to cross the weak mechanical interface at the respective time step of the plurality of time steps; and fracturing the subterranean formation, wherein a fluid viscosity or a fluid flow rate or both are selected using the calculated fracture height growth.

2. The method of claim 1, wherein the weak mechanical interface comprises elastic interaction, crossing criterion, and re-initiation past-interface.

3. The method of claim 1, wherein the weak mechanical interface comprises enhanced leak-off of a fracturing fluid into the weak mechanical interface.

4. The method of claim 1, wherein the identifying comprises a minimum horizontal stress variation as a function of depth.

5. The method of claim 1, wherein the identifying comprises an elastic moduli contrast between adjacent and different lithological layers.

6. The method of claim 1, wherein the characterizing uses vertical boundaries of a rock layer, a vertical coordinate, stress directions, stress magnitudes, elasticity, fracture toughness, tensile strength, coefficient of friction, hydraulic conductivity, or a combination thereof.

7. The method of claim 1, wherein the characterizing further comprises using operational hydraulic parameters.

8. The method of claim 7, wherein the operational hydraulic parameters comprise fluid viscosity or injection rate or both.

9. The method of claim 1, wherein the identifying comprises fracture growth characteristics.

10. The method of claim 1, wherein the identifying comprises fracture tip characteristics of the formation fracture tip.

11. The method of claim 1, wherein the identifying comprises volume of leak-off into formation or pressure variation or both.

12. The method of claim 1, wherein the identifying comprises a fracture propagation solution.

13. The method of claim 1, wherein the identifying comprises defining an optimum fracture height.

14. The method of claim 13, wherein the identifying comprises comparing the identified formation fracture height with the optimum fracture height.

15. A method for hydraulic fracturing a subterranean formation traversed by a wellbore, comprising:

measuring mechanical properties of geological interfaces of the subterranean formation;

characterizing the subterranean formation using the measurements, wherein characterizing the subterranean formation comprises characterizing a weak mechanical interface between adjacent lithological layers;

calculating a formation fracture height based at least in part on a respective fracture height growth iteratively calculated using the subterranean formation characterization for each time step of a plurality of time steps to determine whether a formation fracture tip crosses the weak mechanical interface at a respective time step of the plurality of time steps, wherein the respective fracture height growth is iteratively calculated by identifying respective fracturing fluid properties that cause the formation fracture tip to cross the weak mechanical interface at the respective time step of the plurality of time steps;

calculating an optimum fracture height using the measurements; and comparing the optimum fracture height to the formation fracture height.

16. The method of claim 15, wherein calculating the formation fracture height comprises using volume of leak-off into pre-existing permeable geological discontinuities.

17. The method of claim 15, wherein the weak mechanical interface comprises elastic interaction, crossing criterion, and re-initiation past-interface.

18. The method of claim 15, wherein the weak mechanical interface comprises enhanced leak-off of a fracturing fluid into the weak mechanical interface.

19. A method for hydraulic fracturing a subterranean formation traversed by a wellbore, comprising:

characterizing the subterranean formation using measured properties of the subterranean formation, wherein the measured properties of the subterranean formation include mechanical properties of geological interfaces, and wherein characterizing the subterranean formation comprises characterizing a plurality of weak mechanical interfaces between respective adjacent lithological layers;

identifying a formation fracture height between a first formation fracture tip and a second formation fracture tip, wherein the identifying comprises iteratively calculating a respective fracture height growth using the subterranean formation characterization for each time step of a plurality of time steps to determine whether the first formation fracture tip crosses a first weak mechanical interface of the plurality of weak mechanical interfaces at a respective time step of the plurality of time steps, and to determine whether the second formation fracture tip crosses a second weak mechanical interface of the plurality of weak mechanical interfaces at the respective time step of the plurality of time steps, and wherein the iteratively calculating comprises identifying respective fracturing fluid properties that cause the first and second formation fracture tips to cross the respective first and second weak mechanical interfaces at the respective time step of the plurality of time steps; and fracturing the subterranean formation, wherein a fluid viscosity or a fluid flow rate or both are selected using the calculated fracture height growth.

* * * * *